US006035784A

United States Patent [19]

Watson

[11] Patent Number: 6,035,784

[45] Date of Patent: Mar. 14, 2000

[54] METHOD AND APPARATUS FOR CONTROLLED SMALL-CHARGE BLASTING OF HARD ROCK AND CONCRETE BY EXPLOSIVE PRESSURIZATION OF THE BOTTOM OF A DRILL HOLE

[75] Inventor: John David Watson, Evergreen, Colo.

[73] Assignee: Rocktek Limited, Wester Australia, Australia

[21] Appl. No.: 08/692,053

[22] Filed: Aug. 2, 1996

Related U.S. Application Data

[60] Provisional application No. 60/001,929, Aug. 4, 1995.

[51] Int. Cl.[7] ..... F42B 3/00; E21B 7/00

[52] U.S. Cl. ..... 102/313; 102/312; 102/333; 175/4.58; 175/4.6

[58] Field of Search ..... 102/312, 313, 102/333; 175/4.58, 4.6, 4.51, 4.52, 4.57

[56] References Cited

U.S. PATENT DOCUMENTS

| | | | |
|---|---|---|---|
| 1,189,011 | 6/1916 | Smith | 102/430 |
| 1,585,664 | 5/1926 | Gilman | 299/13 |
| 2,281,103 | 4/1942 | MacDonald | 102/4 |
| 2,587,243 | 2/1952 | Sweetman | 102/307 |
| 2,725,821 | 12/1955 | Coleman | 102/22 |
| 2,799,488 | 7/1957 | Mandt | 299/13 |
| 3,055,648 | 9/1962 | Lawrence et al. | 299/13 X |
| 3,307,445 | 3/1967 | Stadler et al. | 102/313 X |
| 3,313,234 | 4/1967 | Mohaupt | 102/20 |
| 3,421,408 | 1/1969 | Badali et al. | 89/33.1 |
| 3,623,771 | 11/1971 | Sosnowicz et al. | 299/12 |
| 3,721,471 | 3/1973 | Bergmann et al. | 299/55 |
| 3,735,704 | 5/1973 | Livingston | 102/332 |
| 3,818,906 | 6/1974 | Beck | 102/313 X |
| 3,848,927 | 11/1974 | Livingston | 299/13 |
| 3,975,056 | 8/1976 | Peterson | 299/42 |
| 3,988,037 | 10/1976 | Denisart et al. | 299/16 |
| 4,007,783 | 2/1977 | Amancharla et al. | 166/135 |
| 4,040,355 | 8/1977 | Hopler, Jr. | 102/313 |
| 4,099,784 | 7/1978 | Cooper | 299/10 |
| 4,123,108 | 10/1978 | Lavon | 299/16 |

(List continued on next page.)

FOREIGN PATENT DOCUMENTS

| | | | |
|---|---|---|---|
| 800883 | 9/1958 | United Kingdom | 299/16 |

OTHER PUBLICATIONS

Sunburst Recovery, Inc., "Controlled Fracture Techniques for Continuous Drill and Blast", NSF Report, Jul. 1984.

Bligh, "Principles of Breaking Rock Using High Pressure Gases", Advances in Rock Mechanics, Denver 1974.

Cooper et al., "A Novel Concept for a Rock–Breaking Machine . . . ", Institute Cerac S.A., Switzerland, 1980.

Dalley et al., "Fracture Control in Construction Blasting", University of Maryland, 1977.

*Primary Examiner*—Peter A. Nelson

*Attorney, Agent, or Firm*—Sheridan Ross PC.

[57] ABSTRACT

Rock and other hard materials, such as concrete, are fragmented by a controlled small-charge blasting process. A cartridge containing an explosive charge is inserted at the bottom of a hole drilled in the rock. The explosive charge is configured to provide the desired pressure in the hole bottom, including, if desired, a strong shock spike at the hole bottom to enhance microfracturing. The cartridge is held in place or stemmed by a massive stemming bar of high-strength material such as steel which blocks the flow of gas up the drill hole except for a small leak path between the stemming bar and the drill hole walls. The cartridge-incorporates additional internal volume designed to control the application of pressure in the bottom hole volume by the detonating explosive.

20 Claims, 20 Drawing Sheets

U.S. PATENT DOCUMENTS

| | | | |
|---|---|---|---|
| 4,140,188 | 2/1979 | Vann | 175/4.51 |
| 4,141,592 | 2/1979 | Lavon | 299/16 |
| 4,149,604 | 4/1979 | Lockwood et al. | 175/57 |
| 4,165,690 | 8/1979 | Abrahams | 102/314 |
| 4,195,885 | 4/1980 | Lavon | 299/1 |
| 4,204,715 | 5/1980 | Lavon | 299/16 |
| 4,208,966 | 6/1980 | Hart | 102/20 |
| 4,289,275 | 9/1981 | Lavon | 299/17 X |
| 4,501,199 | 2/1985 | Mashimo et al. | 102/313 |
| 4,508,035 | 4/1985 | Mashimo et al. | 102/313 |
| 4,530,396 | 7/1985 | Mohaupt | 102/313 X |
| 4,582,147 | 4/1986 | Dardick | 175/1 |
| 4,632,034 | 12/1986 | Colle, Jr. | 102/313 X |
| 4,655,082 | 4/1987 | Peterson | 299/1 X |
| 4,669,783 | 6/1987 | Kolle | 299/16 |
| 4,886,126 | 12/1989 | Yates, Jr. | 175/4.54 |
| 4,900,092 | 2/1990 | Van Der Westhuizen et al. | 299/13 |
| 5,098,163 | 3/1992 | Young, III | 299/13 |
| 5,211,224 | 5/1993 | Bouldin | 166/63 |
| 5,247,886 | 9/1993 | Worsey | 102/333 X |
| 5,308,149 | 5/1994 | Watson et al. | 102/313 X |
| 5,564,499 | 10/1996 | Willis et al. | 166/299 |
| 5,705,768 | 1/1998 | Ey | 102/312 X |
| 5,714,712 | 2/1998 | Ewick et al. | 102/312 X |

METHOD AND APPARATUS FOR CONTROLLED SMALL-CHARGE BLASTING OF HARD ROCK AND CONCRETE BY EXPLOSIVE PRESSURIZATION OF THE BOTTOM OF A DRILL HOLE

The present application claims priority from copending U.S. Provisional Application Ser. No. 60/001,929 entitled "METHOD AND APPARATUS FOR CONTROLLED SMALL-CHARGE BLASTING OF HARD ROCK AND CONCRETE BY EXPLOSIVE PRESSURIZATION OF THE BOTTOM OF A DRILL HOLE", filed Aug. 4, 1995, which is incorporated herein by reference in its entirety.

FIELD OF THE INVENTION

The present invention relates generally to small charge blasting techniques for excavating rock and other materials and specifically, to the use of explosives in small charge blasting techniques for excavating massive hard rock and other hard materials.

BACKGROUND OF THE INVENTION

The excavation of rock is a primary activity in the mining, quarrying and civil construction industries. There are a number of unmet needs of these industries relating to the excavation of rock and other hard materials. These include:

Reduced Cost of Rock Excavation

Increased Rates of Excavation

Improved Safety and Reduced Costs of Safety

Better Control Over the Precision of the Excavation Process

Cost Effective Method of Excavation Acceptable in Urban and Environmentally Sensitive Areas Drill & blast methods are the most commonly employed and most generally applicable means of rock excavation. These methods are not suitable for many urban environments because of regulatory restrictions. In production mining, drill and blast methods are fundamentally limited in production rates while in mine development and civil tunneling, drill and blast methods are fundamentally limited because of the cyclical nature of the large-scale drill & blast process.

Tunnel boring machines are used for excavations requiring long, relatively straight tunnels with circular cross-sections. These machines are rarely used in mining operations.

Roadheader machines are used in mining and construction applications but are limited to moderately hard, non-abrasive rock formations.

Mechanical impact breakers are currently used as a means of breaking oversize rock, concrete and reinforced concrete structures. As a general excavation tool, mechanical impact breakers are limited to relatively weak rock formations having a high degree of fracturing. In harder rock formations (unconfined compressive strengths above 120 MPa), the excavation effectiveness of mechanical impact breakers drops quickly and tool bit wear increases rapidly. Mechanical impact breakers cannot, by themselves, excavate an underground face in massive hard rock formations.

Small-charge blasting techniques can be used in all rock formations including massive, hard rock formations. Small-charge blasting includes methods where small amounts of blasting agents (typically 2 kilograms or less) are consumed at any one time, as opposed to episodic conventional drill and blast operations which involve drilling multiple hole patterns, loading holes with explosive charges, blasting by millisecond timing the blast of each individual hole and in which tens to thousands of kilograms of blasting agent are used. Small-charge blasting may involve shooting holes individually or shooting several holes simultaneously. The seismic signature of small-charge blasting methods is relatively low because of the small amount of blasting agent used at any one time.

An example of a small-charge blasting method is represented by U.S. Pat. No. 5,098,163 entitled "Controlled Fracture Method and Apparatus for Breaking Hard Compact Rock and Concrete Materials". This patent relates to breaking rock by inducing a characteristic type of fracture called Penetrating Cone Fracture (PCF) by using a gun-like device or gas-injector to burn propellant in a combustion chamber. The burning and burnt propellant then expands down a short barrel and into the bottom of the hole where it pressurizes the bottom of the hole to induce fracturing. This process is referred to herein as the Injector method. The Injector method has difficulty in water filled holes which can damage the muzzle of the gas-injector. Another disadvantage of the Injector method is the requirement to burn additional propellant in the injector to pressurize the internal volume of the injector. This additional propellant, when burned, ultimately contributes to the air-blast, ground vibration and flyrock energies, all of which are unwanted by-products of the rock-breaking process.

The following describes a method and means of small-charge blasting to break rock efficiently and with low-velocity fly-rock such that drilling, mucking, haulage and ground support equipment can remain at the working face during rock breaking operations.

SUMMARY OF THE INVENTION

Objectives of the present invention are to provide an excavation technique that is relatively low cost, provides high rates of excavation, is safe for personnel, offers a high degree of control and precision in the excavation process, and is acceptable in urban and in environmentally sensitive areas.

These and other objectives are realized by the present invention which is a device for fracturing a hard material, such as massive rock or concrete, that includes:

(i) a cartridge; and (ii) a stemming means for holding the cartridge in a hole in the material.

The cartridge, which is located adjacent to an end of the stemming means, includes:

(i) a cartridge base positioned adjacent to the end of the stemming means; and (ii) an outer cartridge housing attached to the cartridge base. A first portion of the outer cartridge housing contains an explosive and a second portion a space for controlling the gas pressure in the hole. The explosive is positioned at a distance from the cartridge base to dissipate a detonation shock wave generated during detonation of the explosive. Typically, the cartridge base is sacrificial and not reusable. The spacing of the explosive from the cartridge base and the use of a sacrificial cartridge base permits re-use of the stemming means. The device is especially useful in small charge blasting applications where relatively low weights of charge are employed to cause material breakage.

The space for controlling the gas pressure in the hole prevents overpressurization of the gas in the hole bottom.

The volume of the space preferably ranges from about 200 to about 500% of the volume of the explosive.

The sacrificial cartridge base is designed to experience plastic deformation in response to the attenuated detonation shock wave before the stemming means. In this manner, damage to the stemming means is inhibited and the stemming means is reuseable. The preferential plastic deformation of the cartridge base rather than the stemming means results from the cartridge base having a lower yield strength than the stemming means. Preferably, the yield strength of the cartridge base is no more than about 75% of the yield strength of the stemming means. The cartridge base preferably has a thickness ranging from about 0.5 to about 2 inches, a diameter ranging from about 50 to about 250 mm, and a length-to-diameter ratio ranging from about 0.15 to about 0.60.

To substantially optimize fracturing of the material, the explosive is in close proximity to the bottom of the hole. Preferably, the distance of the explosive from the bottom of the hole is no more than about 15 millimeters.

To cause the outer cartridge housing to experience a high degree of fragmentation, the wall thickness of the outer cartridge housing is relatively thin. Preferably, the nose portion of the outer cartridge housing located at the opposite end of the outer cartridge housing from the cartridge base has a thickness ranging from about 0.75 to about 4 millimeters. The cartridge has a length-to-diameter ratio preferably ranging from about 1 to about 4.

The stemming means and cartridge base can include guidance means for aligning the cartridge base relative to the end of the stemming means. In one embodiment, the guidance means is provided by the use of matching mating surfaces at the downhole end of the stemming means and the upper end of the cartridge base.

DETAILED DESCRIPTION OF THE PREFERRED EMBODIMENT

Figure 1:
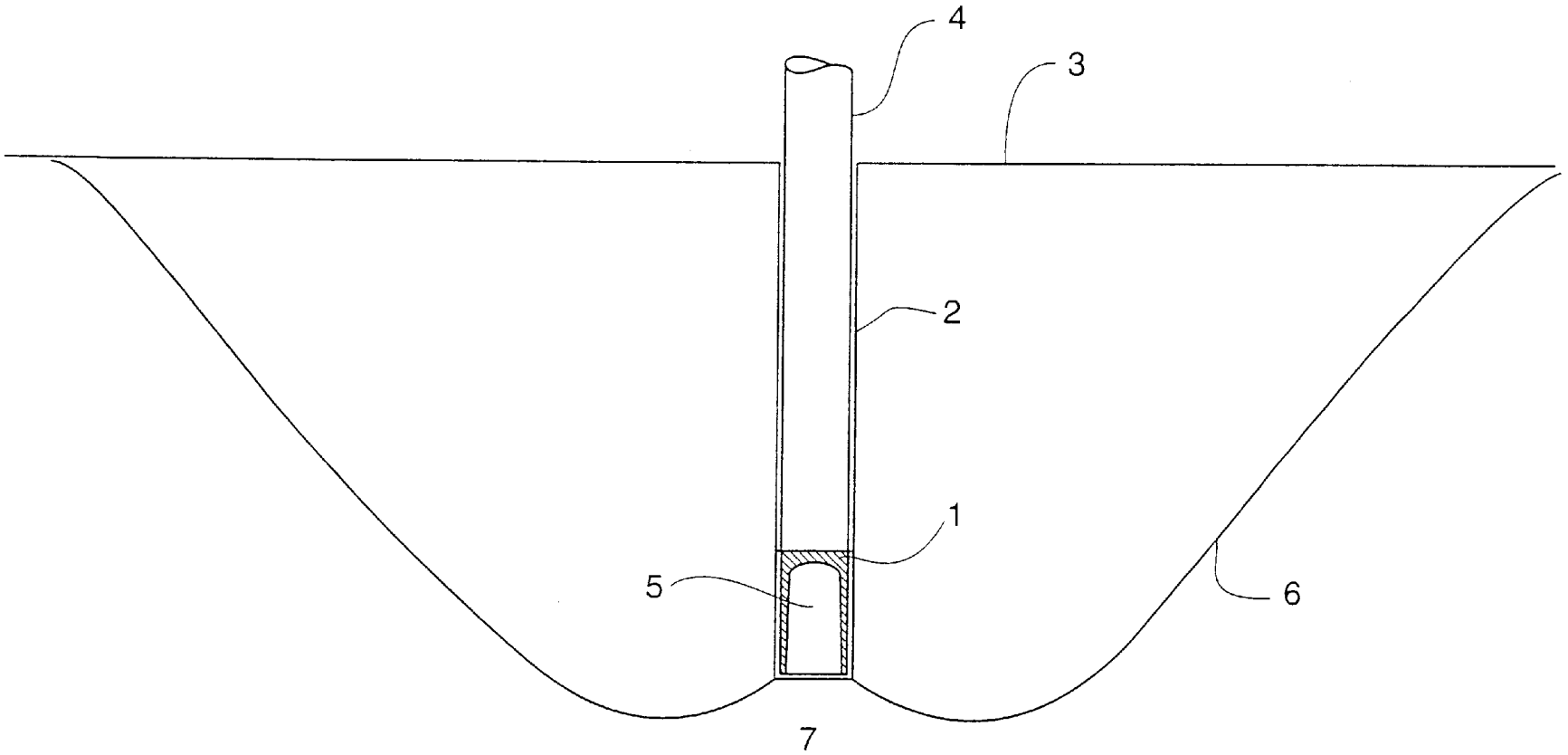
FIG. 1 is a cutaway side view of the present SCB-EX controlled fracture process after detonating an explosive containing cartridge held in the bottom of a drill hole by a massive stemming bar, shown having created a penetrating cone type fracture which is typical of hard unjointed rock formations.

The present invention involves breaking rock or other hard material such as concrete, by drilling a short hole, placing a cartridge containing an explosive charge in the drill hole, positioning a massive stemming bar in the drill hole in contact with the cartridge, and detonating the explosive. This method is a small-charge blasting process as opposed to a mechanical method or multiple hole pattern drill & blast type method for breaking rock. A small charge blasting method implies that the rock is broken out in small amounts (typically on the order of ½ to 3 cubic meters per shot) as opposed to episodic conventional drill and blast operations which involve drilling multiple hole patterns, loading holes with explosive charges, blasting by timing the blast of each individual hole, ventilating and mucking cycles.

Small-charge blasting includes all methods where small amounts of blasting agents (typically a few kilograms or less) are consumed at any one time. Small-charge blasting usually involves shooting holes individually and can include shooting several holes simultaneously. The seismic signature of small-charge blasting methods is relatively low because of the small amount of blasting agent used at any one time. Underground small-charge blasting typically involves the removal of from about 0.3 to about 10, more preferably from about 1 to about 10 and most preferably from about 3 to about 10 bank cubic meters per shot using from about 0.15 to about 0.5 more preferably from about 0.15 to about 0.3 and most preferably from about 0.15 to about 0.2 kilograms of blasting agent, depending on the method used. Surface small-charge blasting removes an amount of material typically ranging from about 10 to about 100, more preferably from about 15 to about 100, and most preferably from about 20 to about 100 bank cubic meters of rock per shot using from about 1 to about 3, more preferably from about 1 to about 2.5 and most preferably from about 1 to about 2 kilograms of blasting agent, depending on the method used. Bank cubic meters are the cubic meters of in-place rock, not the cubic meters of loose rock dislodged from the rock face. The amount of small-charge blasting agent per shot ranges preferably from about 0.1 kilogram to about 2 kilograms, more preferably from about 0.1 kilograms to 1 kilogram and most preferably from about 0.1 kilogram to 0.4 kilograms.

In the present invention, the principal method by which the gas-pressures are contained at the hole bottom is by a massive reusable stemming bar which confines the pressure in the hole bottom by inertially controlling and minimizing recoil of the cartridge during the rock-breaking process. By controlling the geometry of the explosive charge, the bottom of the drill hole can be pressurized in a manner most suitable for efficient breakage in rock formations ranging from soft, fractured rock to hard massive. This method of small charge controlled blasting is referred to herein as the Small-Charge Blasting—Explosive or SCB-EX method. This method induces a controlled fracturing of the rock which is considerably more energy efficient than current drill and blast method or mechanical rock excavation methods.

The present invention represents a significantly different means to induce hole-bottom controlled fracturing, such as the Penetrating Cone Fracture (PCF) type of rock fracture. It differs from the Injector method in that an explosive charge is placed directly into the bottom of a percussively drilled hole. It differs from the Charge-in-the-Hole method (i.e., described in U.S. Pat. No. 5,308,149 which is incorporated herein by this reference) in that (1) a detonating explosive is used rather than a non-detonating propellant; (2) the explosive can be configured to enhance microfracturing at the hole bottom; (3) the pressure loading of the hole bottom is far more rapid; and (4) the cartridge does not play a role in the combustion of the blasting agent. However, it retains or improves upon the major advantages of the Injector and Charge-in-the-Hole methods in that rock is broken efficiently and the resulting flyrock is so benign that equipment can remain at the working face while the rock is being broken.

Breakage Mechanism

If the rock is of high strength and massive without extensive jointing, this controlled fracturing may be manifested by a type of primary fracture in the rock that is referred to as Penetrating Cone fracture (PCF). The basic features of PCF rock breakage by the SCB-EX method are illustrated in FIG. 1. PCF breakage is based on the initiation and propagation of an axi-symmetric fracture from the bottom corner of a short, rapidly pressurized drill hole. Such a fracture initially propagates downward into the rock, and then turns towards the free surface as surface effects become important, resulting in the removal of a large volume of rock. The residual cone left on the rock face by the initial penetration of the fracture into the rock provides the basis for the name (Penetrating Cone Fracture, or PCF) given to this type of fracturing.

Figure 2:
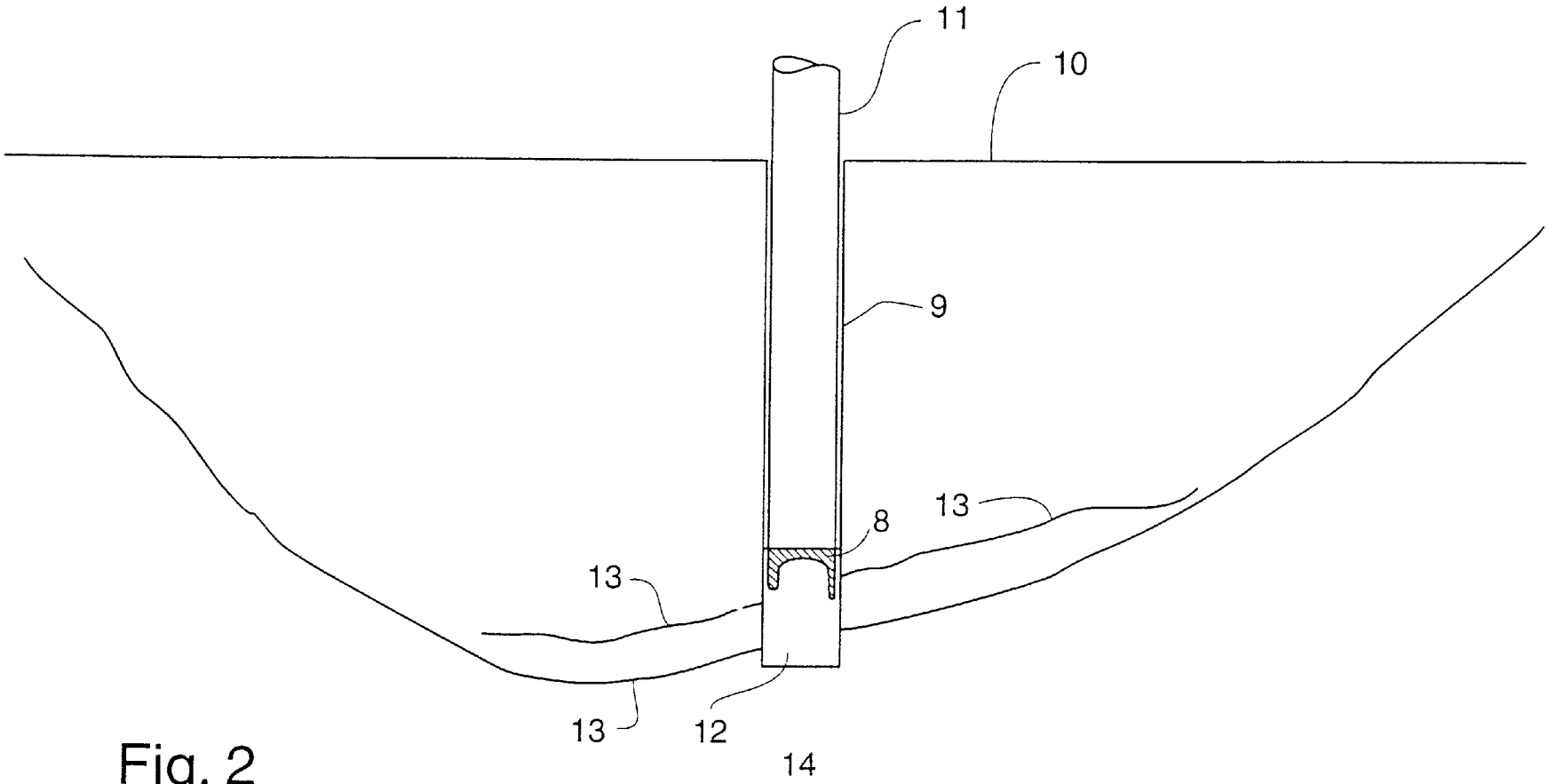
FIG. 2 is a cutaway side view of the present SCB-EX controlled fracture process after detonating an explosive containing cartridge held in the bottom of a drill hole by a massive stemming bar, shown having driven a pre-existing fracture or fractures which intersects the hole near the bottom. This is typical of jointed or fractured rock formations.

If the rock contains joints or other pre-existing fractures that intersect the pressurized hole bottom such as shown in FIG. 2, the controlled fracturing will be manifested by the opening and extension of these as the primary fractures. In either case, the rock breakage is characterized by a controlled fracture caused by properly pressurizing only the bottom of the drill hole.

The Drill Hole

The SCB-EX method may be used in either a constant diameter drill hole or a stepped drill hole. In the case of a stepped drill hole, the hole bottom is drilled at a slightly smaller diameter than the top of the hole. This can be accomplished by a pilot bit with a following reamer bit. The length of the smaller diameter pilot hole is slightly longer than the SCB-EX cartridge. The main purpose of the stepped hole is to provide additional clearance between the stemming bar and the walls of the drill hole to make it easier to insert the cartridge with the stemming bar. The stepped hole also allows the cartridge to be inserted with a closer tolerance fit than would be the case with a constant diameter drill hole, since alignment of the stemming bar with the drill hole is less critical.

The quality of the bottom of the drill hole is an important feature of the SCB-EX process, especially in harder more massive rock formations. The requirements for the hole bottom are a sharp corner and numerous microfractures. This can best be accomplished by percussively drilling the hole with a sharp cornered drill bit.

The corner at the bottom of the hole is where the primary fracture will be initiated in the absence of pre-existing fractures. Once the hole is pressurized, a stress field develops in the rock around the hole and the line of maximum tension runs 45 degrees downward from the corner of the bottom of the hole. The sharper the corner, the higher the stress concentration and the easier it is for a primary fracture to initiate at the corner of the hole bottom.

The microfracturing at the hole bottom also promotes initiation of the primary fracture in the absence of preexisting fractures by weakening the rock around the location where the primary fracture will be initiated. Microfracturing has been found to be approximately as effective as notching the corner of the bottom of the hole. It has been observed that drilling the hole with a percussive drill causes a sufficiently high degree of microfracturing at the hole bottom, at least in soft to moderately hard rock formations, and microfracturing appears to be enhanced by increasing the blow energy of the rock drill near the completion of the hole drilling cycle.

The diameter of the drill hole (taken as the diameter at the hole bottom) for the SCB-EX method ranges preferably from about 50 mm to 250 mm, more preferably from about 50 mm to 125 mm and most preferably from about 75 mm to 100 mm.

The length to diameter ratio (the diameter being taken as the diameter at the hole bottom) of the drill hole for the SCB-EX method ranges preferably from about 4 to 20, more preferably from about 5 to 15 and most preferably from about 5 to 12.

If the drill hole is stepped, the diameter ratio of the larger reamed hole to the smaller pilot hole ranges preferably from about 1.1 to 1.5, more preferably from about 1.15 to 1.4 and most preferably from about 1.15 to 1.25.

Configuration of the Explosive Charge

Figure 3:
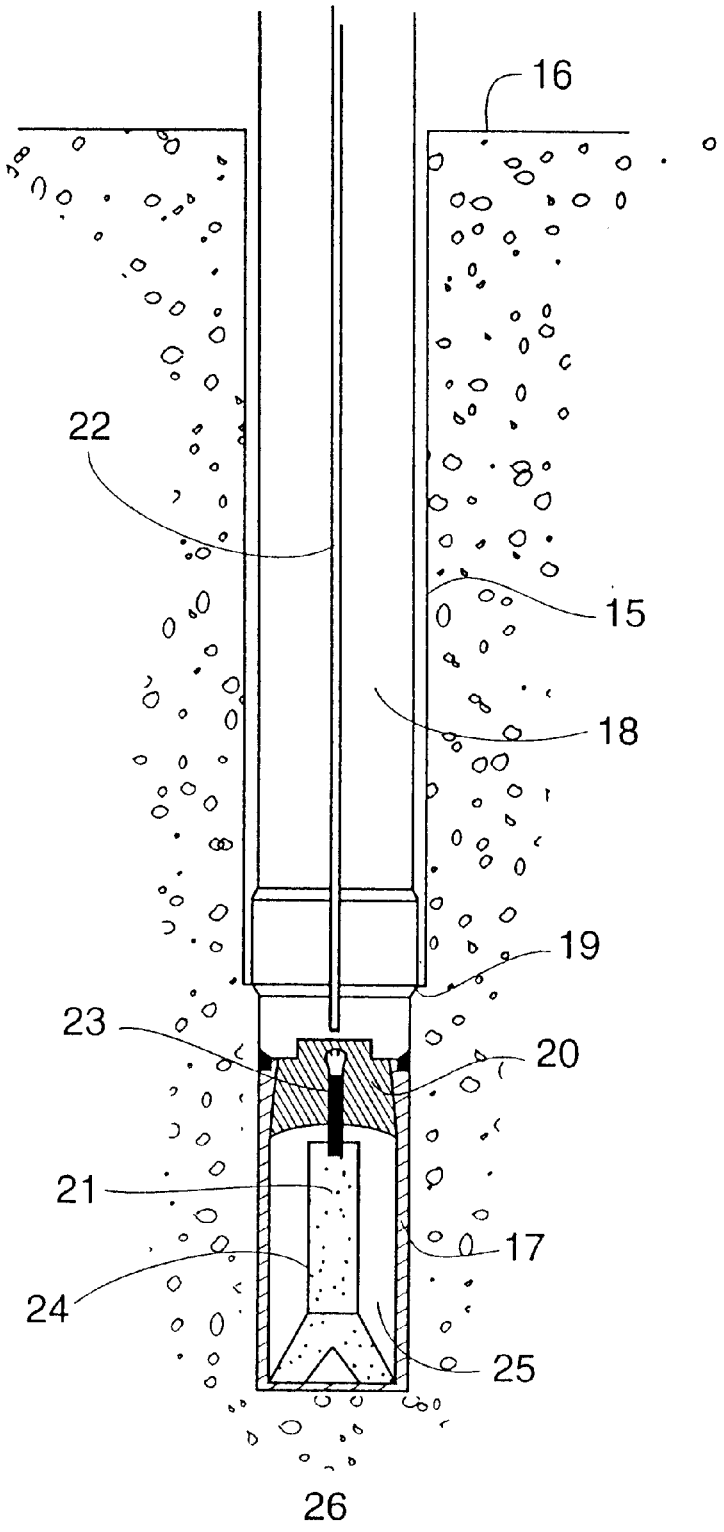
FIG. 3 is a cutaway view of the present SCB-EX process showing the stemming bar and cartridge in the drill hole prior to initiating the explosive.

The basic configuration of the SCB-EX system is shown in FIG. 3, which illustrates the short drill hole, the cartridge containing an explosive charge in the bottom of the hole and a stemming bar to contain the high-pressure gases generated by detonating the explosive, until the rock is fragmented.

The explosive charge, such as FIG. 3 is designed to give an energy release that will result in a desired average pressure in the downhole volume. This average or equilibrium pressure can be computed from the formula:

$$p=(y-1)\rho e(1+\rho\eta)$$

where $\rho$=average gas pressure $\gamma$=ratio of specific heats of the explosive product gases $\rho$=average gas density e=gas energy per unit mass $\eta$=covolume coefficient for the explosive product gases The explosive charge mass for the SCB-EX method varies depending upon the application. In underground excavation, the explosive charge mass preferably ranges from about 0.15 to about 0.5, more preferable from about 0.15 to about 0.3, and most preferably from about 0.15 to about 0.2 kilograms of blasting agent. In surface excavations, the explosive charge mass preferably ranges from about 1 to about 3, more preferably from about 1 to about 2.5, and most preferably from about 1 to about 2 kilograms of blasting agent.

For either close-coupled or decoupled SCB-EX charge configuration, the average or equilibrium pressure developed in the volume available in the hole bottom in the absence of stemming bar recoil, gas leakage or fracture development, based on the equation $p=(\gamma-1)\rho e(1+\rho\eta)$ ranges preferably from about 100 MPa to 1,200 MPa, more preferably from about 200 MPa to 1,000 MPa and most preferably from about 200 MPa to 750 MPa.

Figure 4:
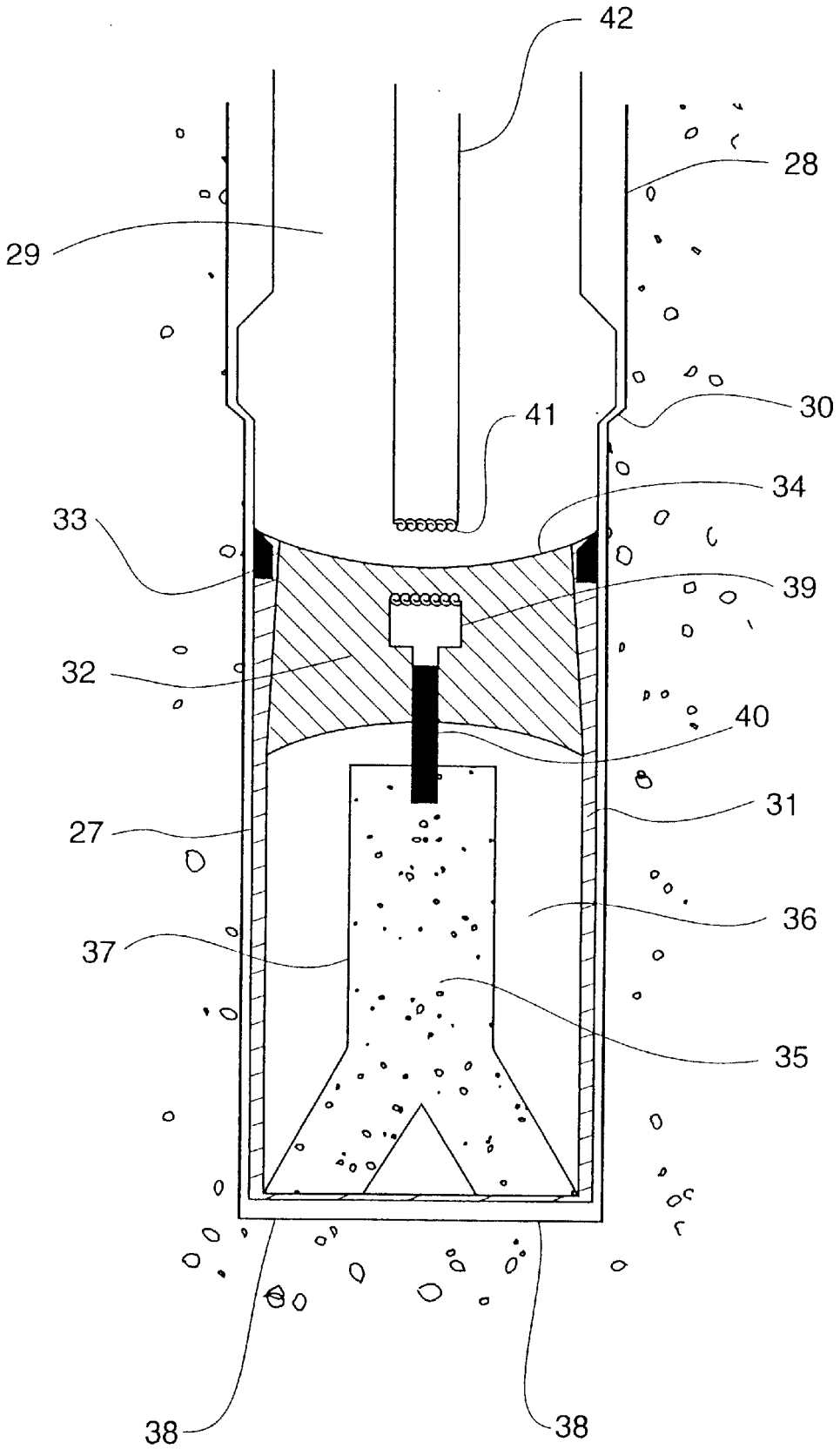
FIG. 4 is a cutaway close up side view of an SCB-EX cartridge and stemming bar means showing the recoiling base plug design of the cartridge and the explosive charge configuration for close-coupling to the hole bottom.

In the present method, the explosive charge can be configured to direct a strong shock spike at the hole bottom as shown in FIG. 4. A strong shock spike consists of a strong shock followed immediately by a sharp rarefaction wave such that the rise and fall of pressure occurs during a time that is short compared to the time required for a seismic wave to cross the volume of rock affected by the spike. A strong shock spike consists of a strong shock followed immediately by a sharp rarefaction wave such that the risk and fall of pressure occurs during a time that is short compared to the time required for a seismic wave to cross the volume of rock affected by the spike. When the explosive charge is close coupled to the hole bottom, a strong shock spike is driven into the rock at the hole bottom and additional microfractures are induced as the compressive strength of the rock is substantially exceeded. Increased microfracturing promotes easier initiation of the primary fracture system. This ability may prove decisive in very hard, massive rock formations where the blow energy of the drill is limited. The explosive charge can be configured to directly couple only around the region of the corner of the hole bottom to create microfracturing only near the corner of the hole bottom where it is desired to initiate the main fracture.

In the SCB-EX charge configuration for close coupling of the explosive charge to the hole bottom, the amplitude of the shock spike measured at the hole bottom ranges preferably from about 1,500 MPa to 5,000 MPa, more preferably from about 2,000 MPa to 4,500 MPa and most preferably from about 2,500 MPa to 3,500 MPa.

Figure 5:
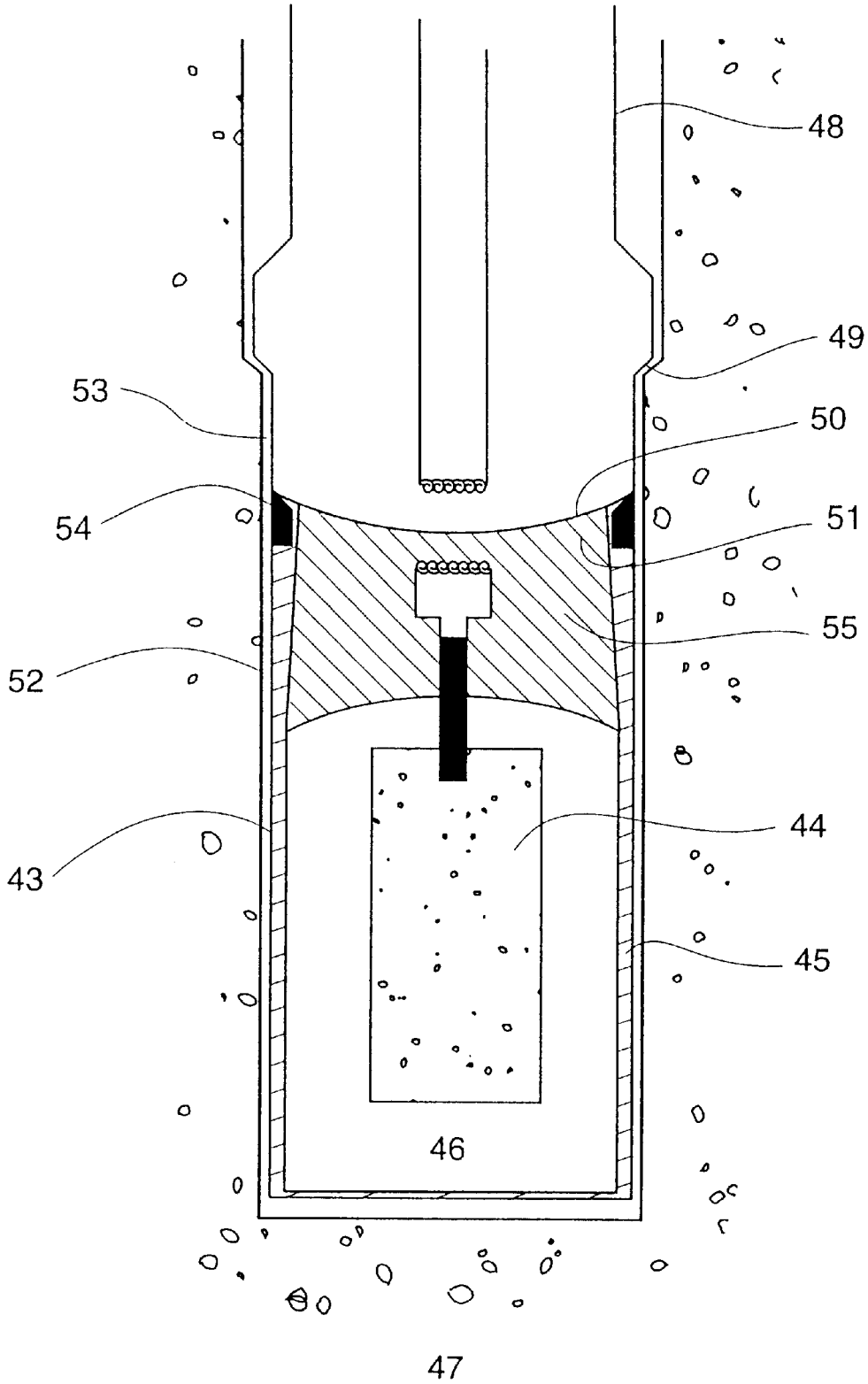
FIG. 5 is a cutaway close up side view of an SCB-EX cartridge and stemming bar means showing the recoiling base plug design of the cartridge and the explosive charge configuration for decoupling the pressure spike from the hole bottom.

The strong shock spike can be reduced or eliminated by introducing a gap between the end of the explosive charge and the hole bottom as shown in FIG. 5. This may be desirable in softer, highly fractured rock formations where only the generation of gas with no strong shock component is desired. The strength of the shock spike impacting the bottom of the drill hole can be controlled by the size of the gap between the end of the explosive charge and the hole bottom.

In the SCB-EX charge configuration for an explosive charge decoupled from the hole bottom, the length of the gap separating the bottom of the explosive charge from the bottom of the hole ranges preferably from about 19 mm to 60 mm, more preferably from about 10 mm to 50 mm and most preferably from no more than about 40 mm.

In the SCB-EX charge configuration for an explosive charge decoupled from the hole bottom, the amplitude of the shock spike measured at the hole bottom ranges preferably from about 600 MPa to 2,000 MPa, more preferably from about 600 MPa to 1,500 MPa and most preferably from about 600 MPa to 1,000 MPa.

Because of the high pressures, in the range of 100 MPa to 1,000 MPa, required to properly effect the controlled fracturing of hard rock, or comparable materials, several innovative design and application concepts had to be realized and are the subject of the present invention. The pressures developed within a SCB-EX explosive cartridge and applied to the hole bottom are less than those generated in conventional drill & blast where the explosive charge substantially fills the drill hole and contacts the walls of the drill hole and exposes the rock in the immediate vicinity of the drill hole to the full detonation pressure of the explosive. Gas pressures sufficient for controlled fracture development but below those which would rupture the cartridge may thus be attained in a controlled manner. The pressures thus developed are maintained below those which would deform or damage the end of the stemming bar and below those which would crush the rock around the hole. However, the pressures generated in the SCB-EX process controlled and the rock walls near the hole bottom are exposed to pressures comparable to those occurring in the breech of a high-performance gun.

The SCE-EX Cartridge

The main functions of the cartridge are: (1) to protect the explosive charge during insertion into the drill hole; (2) provide the necessary internal volume to control the pressures developed in the hole bottom; (3) to protect the explosive charge from water in a wet drill hole and; (4) to provide the stemming bar with isolation from any strong shock transients from the explosive charge.

The wall of the cartridge adjacent to the base plug may be designed to expand to the drill hole wall without rupturing, thus preventing the high-pressure explosive product gases from acting directly on the hole wall or in any fractures (natural or induced) along the hole wall. This containment of explosive product gases maintains the gas pressure so that the gases act predominantly to form and pressurize the desired controlled fractures, such as a penetrating-cone-fracture originating at the stress concentration developed at the bottom of the hole. It is important to prevent hot gases from escaping up the hole around the steel bar. Such gas escape can reduce, by a small amount, both the pressure and volume of gas available for the desired SCB-EX controlled fracturing. Also the escaping gases could damage the stemming bar by convective heat transfer erosion processes. As noted above, the escape of gases past the reusable stemming bar may be reduced by having a small clearance between the bar and the hole wall. Calculations with a finite difference code indicate that an annular clearance of less than 0.38 mm in a 76-mm diameter drill hole will adequately minimize the escape of high-pressure gases.

Additional cartridge integrity is obtained by including a sliding conical base plug in the cartridge such as shown in FIGS. 4 and 5. In these embodiments, the cartridge comprises a tapered wall section with a cylindrical exterior and a conical interior and a basal sealing plug of mating conical shape which can move inside the conical interior wall of the cartridge. As the stemming bar recoils out of the hole by the pressure of the gases, the basal plug can follow and thus maintain a seal against the explosive product gases for a time long enough to complete the controlled hole-bottom fracture process.

The amount of recoil that occurs during the time the pressure is developed in the hole bottom and the fragmentation of the rock is complete ranges preferably from about 5 mm to 50 mm, more preferably from about 10 mm to 40 mm and most preferably from about 10 mm to 20 mm. The amount of recoil is primarily controlled by the inertial mass of the stemming bar system and the pressure history developed in the hole bottom.

For either close-coupled or decoupled SCB-EX charge configuration, the angle between the cartridge base and the wall of the cartridge body in which the base may move during recoil ranges preferably from about 1 degree to 10 degrees, more preferably from about 2 degrees to 8 degrees and most preferably from about 3 degrees to 6 degrees.

The wall of the cartridge is thin at and near the hole bottom. It should be thick enough to withstand the process of inserting the cartridge into the drill hole. But it should be thin enough to fragment when the explosive charge is detonated so as to leave no fragments large enough to plug the fractures initiated at the hole bottom corner. For either close-coupled or decoupled SCB-EX charge configuration, the thickness of the outer cartridge housing wall adjacent to the hole bottom ranges preferably from about 0.75 mm to 5 mm, more preferably from about 0.75 mm to 4 mm and most preferably from about 0.75 mm to 3 mm. It may be desirable to design notches into the bottom of the cartridge to ensure that it fragments when the explosive is detonated.

The explosive charge such as shown in FIGS. 4 and 5 is detonated and consumed before the influence of the cartridge walls can be felt. Therefore, the design of the cartridge is determined by other factors but not by any consideration of the detonating combustion of the explosive charge. This is contrasted to methods in which non-detonating propellants are used. The cartridge in these methods must be designed to provide some initial confinement to allow the propellant to burn properly up to the desired pressure, thus adding an additional design requirement for the cartridge.

FIG. 4 shows an SCB-EX cartridge geometry including: the downhole end of the stemming bar; a tapered base plug that can slide within the cartridge wall; an explosive charge that is close-coupled to the hole bottom; an internal relief volume to control the long term average pressure of the explosive products; and a back-up metal sealing ring in the event the cartridge wall ruptures near the base plug.

FIGS. 5 shows an SCB-EX cartridge geometry including: the downhole end of the stemming bar; a tapered base plug that can slide within the cartridge wall; an explosive charge that is de-coupled from the hole bottom; an internal relief volume to control the long term average pressure of the explosive products; and a back-up metal sealing ring in the event the cartridge wall ruptures near the base plug.

Figure 6:
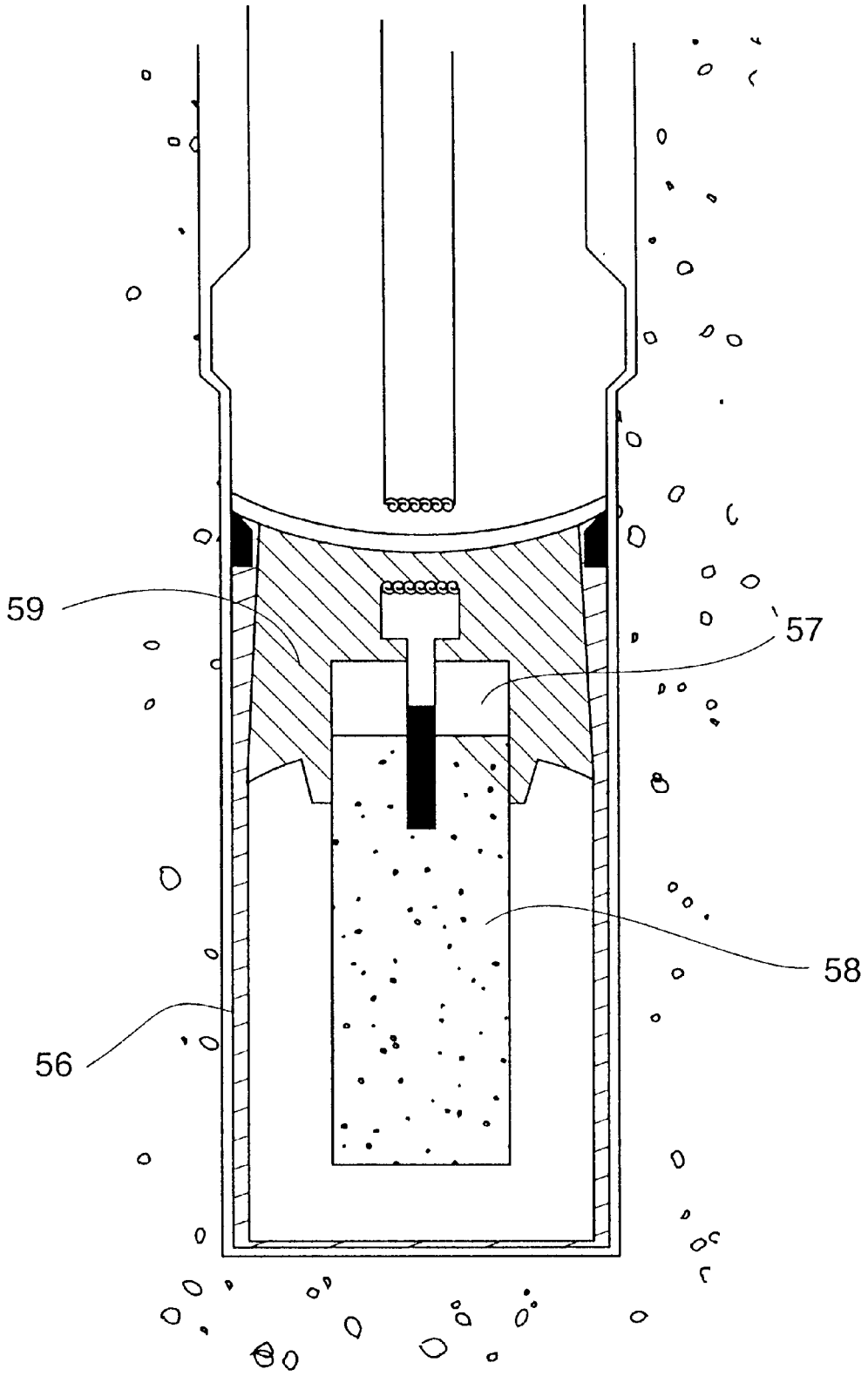
FIG. 6 is a cutaway showing an alternative cartridge configuration in which the explosive charge is decoupled from the hole bottom and in which the explosive charge is mounted in the base plug so as to isolate the stemming bar from any shock transients.

FIG. 6 shows an alternate SCB-EX cartridge geometry including: the downhole end of the stemming bar; a tapered base plug that can slide within the cartridge wall; an explosive charge that is close-coupled to the hole bottom but decoupled from the base plug to isolate the stemming bar from strong shock transients; an internal relief volume to control the long term average pressure of the explosive products; and a back-up metal sealing ring in the event the cartridge wall ruptures near the base plug.

The SCB-EX cartridge may be destroyed in one shot. The end of the stemming bar is exposed to a controlled pressure pulse similar to that generated inside a propellant-driven gun and, if protected such as by the sacrificial tapered base plug and by the shock isolation of gap between the lower end of the cartridge base and the upper end of the explosive, is unlikely to sustain damage over a large number of firings. Even if the end of the stemming bar adjacent to the cartridge is damaged from time to time, it is a relatively simple, low-cost operation to replace or repair the damaged end.

The cartridge can be inserted into the hole in a number of ways. The cartridge can be inserted either mechanically by a long rod or bar; or pneumatically by inserting a flexible tube and blowing the cartridge to the bottom of the hole by a compressed air system with a pressure differential on the order of 1/10 bar. The cartridge can also be inserted directly by attaching the cartridge to the stemming bar itself.

Stemming and Sealing

Figure 7:
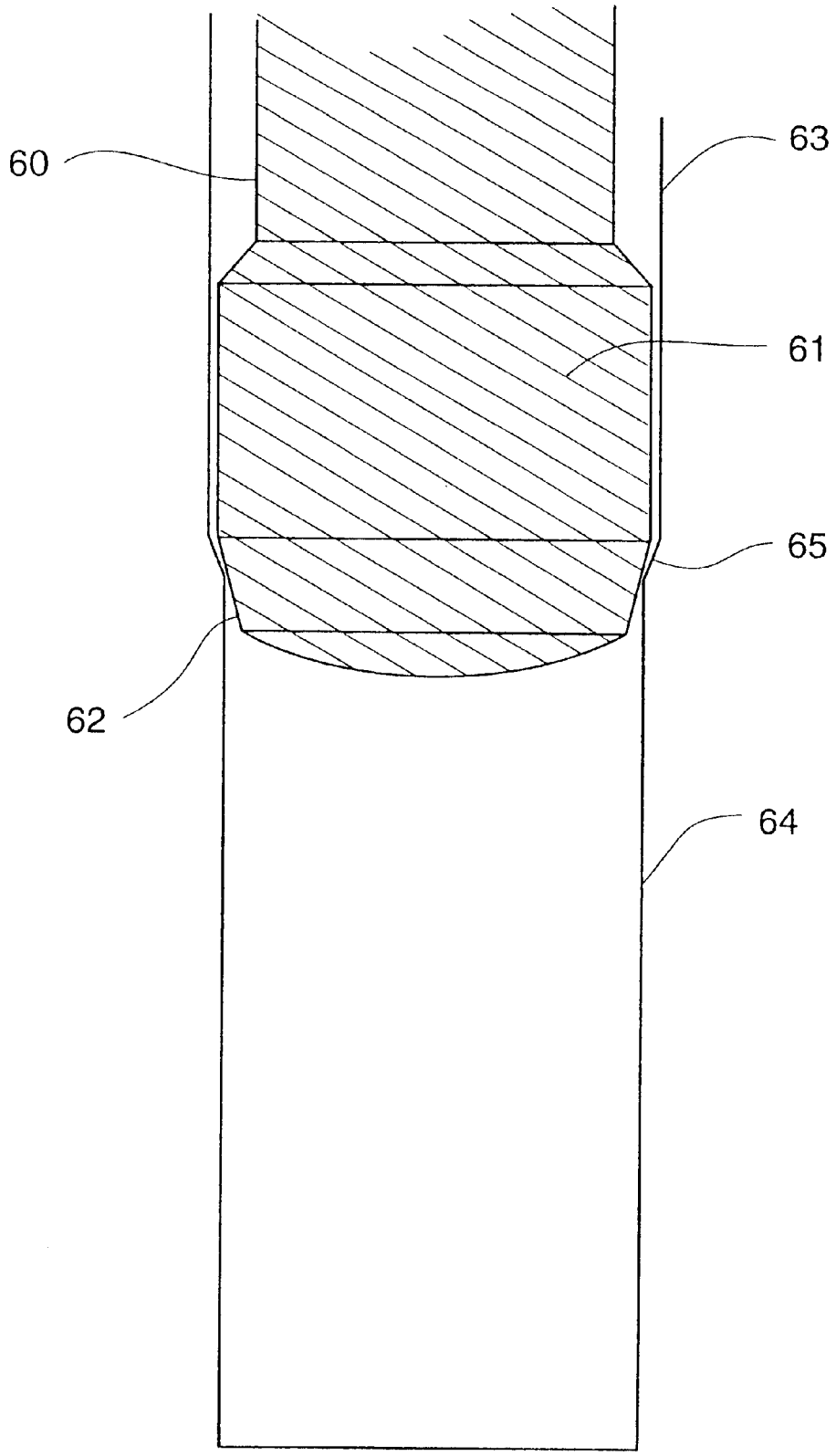
FIG. 7 is a cutaway view of an alternate stemming bar configuration showing a tapered transition to match the tapered transition in the drill hole.

The principal method by which the gas-pressures are contained at the hole bottom until relieved by the opening up of controlled fractures, is by the massive inertial stemming bar which blocks the flow of gas up the drill hole except for a small leak path between the stemming bar and the drill hole walls. This is illustrated in FIGS. 6 and 7 which show two variations of the stemming bar.

The width of the annular gap separating the downhole end of the stemming bar from the walls of the drill hole in firing position ranges preferably from about 0.1 mm to 0.5 mm, more preferably from about 0.1 mm to 0.3 mm and most preferably from about 0.1 mm to 0.2 mm.

This small leakage can be further reduced by design features of the explosive containing cartridge and of the stemming bar. The cartridge may be designed with a tapered wall, which is thicker nearer the stemming bar, and a similarly tapered base plug which can slide within the cartridge walls as the stemming bar recoils. This type of sealing mechanism can reduce the possibility for premature cartridge rupture and leakage of explosively generated gases. A sealing mechanism on the stemming bar may also be used to obtain better or complete sealing near the hole bottom.

The confinement of the high-pressure gases to the hole bottom is realized by the proper interaction of the inertia of the stemming bar which minimizes the recoil displacement of the cartridge, the expansion of the cartridge to the drill hole walls without rupturing and a small clearance between the end of the stemming bar and the hole wall which nearly eliminates the escape of high-pressure gases past the bar during the brief time it takes to initiate, propagate and complete a controlled fracture.

The tip of the stemming bar illustrated in FIG. 6 (also the same as shown in FIGS. 4 and 5) is designed to locate on an abrupt step of a stepped drill hole to avoid crushing the SCB-EX cartridge. The tip of the stemming bar illustrated in FIG. 7 is designed to locate on a smooth transition section between the larger diameter upper portion of the drill hole and the smaller diameter lower portion of the drill hole. This type of drill hole can be formed by a special drill bit assembly. The stemming bar is inserted into the drill hole and the tapered section seats on the tapered section of the drill hole to form an initially tight seal for the high-pressure gases that will be generated in the hole bottom. The high pressure gases will cause the stemming bar to recoil, thus opening up a gap between the tapered section of the stemming bar and the tapered section of the drill hole. The tapered section of the drill hole is less sensitive to chipping and imperfections in the rock than a sharply stepped drill hole such as shown in FIGS. 4,5 and 6 and thus the development of the gap and the leakage of high-pressure gases can be better controlled.

Since the downhole end of the stemming bar fills most of the cross section of the drill hole, it provides adequate sealing of the gas pressures generated by the propellant charge. When the propellant is initiated properly and burns quickly to its peak design pressure, only a small fraction of the propellant gases escape up the gap between the stemming bar and the drill hole walls. This residual gas leak, although it does not seriously degrade the pressure in the hole bottom, can cause damage to the stemming bar over a large number of shots. Design of high-pressure gas sealing features into the cartridge base or downhole end of the stemming bar can reduce or eliminate the residual leakage of explosive product gases.

In addition to or as an alternative to the sealing and gas containment provided by the charge cartridge as described above, sealing may be provided at the cartridge end of the stemming bar. Any of several sealing techniques, such as V-seals, O-rings, unsupported area seals, wedge seals, etcetera may be employed. The seals may be replaced each time a cartridge is fired or, preferably, the seals may be reusable. When the primary sealing function is provided only by the stemming bar, the design of the cartridge may be simplified considerably.

An SCB-EX cartridge and stemming bar may be readily inserted into a hole with such small clearances by drilling a stepped drill hole with a larger-diameter upper-portion section, as illustrated in FIG. 5 for example.

Hole sealing can be assisted and apparatus weight can be reduced by accelerating the stemming bar toward the hole bottom just prior to igniting the propellant in the cartridge. The stemming bar can be accelerated by the hydraulic or pneumatic power source that is used to move the boom or carrier for the SCB-EX apparatus, or by any other means that are available. The stemming bar is accelerated to a velocity directed towards the hole bottom, which is comparable to the oppositely directed recoil velocity induced by burning the propellant. These velocities are on the order of 5 to 50 feet per second. The pre-firing acceleration must be sufficient to achieve the desired velocity in a short distance, on the order of a third of a hole diameter (an inch or less in a 3-inch diameter hole). This technique is referred to as "firing out-of-battery" and is sometimes employed in the operation of large guns to reduce recoil forces.

Since the recoil velocity of the SCB-EX apparatus plays an important role in the hole sealing process, it is desirable to minimize recoil velocity. The firing out-of-battery technique can accomplish this. Alternatively, if recoil velocity is acceptable, this technique can be employed to reduce the recoil mass. In the SCB-EX method, the SCB-EX apparatus serves as a large part of the recoil mass and thus the weight of the apparatus may be reduced. Weight reduction is an important goal since the carrier and boom can operate more efficiently with less weight associated with the drill and SCB-EX apparatus.

The firing out-of-battery technique can also be used to assist the sealing operation when sealing is provided by the explosive cartridge. The seal provided by the cartridge is usually broken when the base of the cartridge ruptures and separates from the body of the cartridge as the stemming bar recoils out of the hole (the body of the cartridge is held against the drill hole walls by the high-pressure explosive product gases and cannot move relative to the hole). By firing out-of-battery, the recoil velocity of the stemming bar can be reduced and the out-of-hole displacement of the stemming bar can be delayed, giving the high-pressure explosive product gases significantly more time to act on the hole bottom and drive the desired controlled fracturing to completion.

Performance Comparisons with Other Small-Charge Methods

Figure 8:
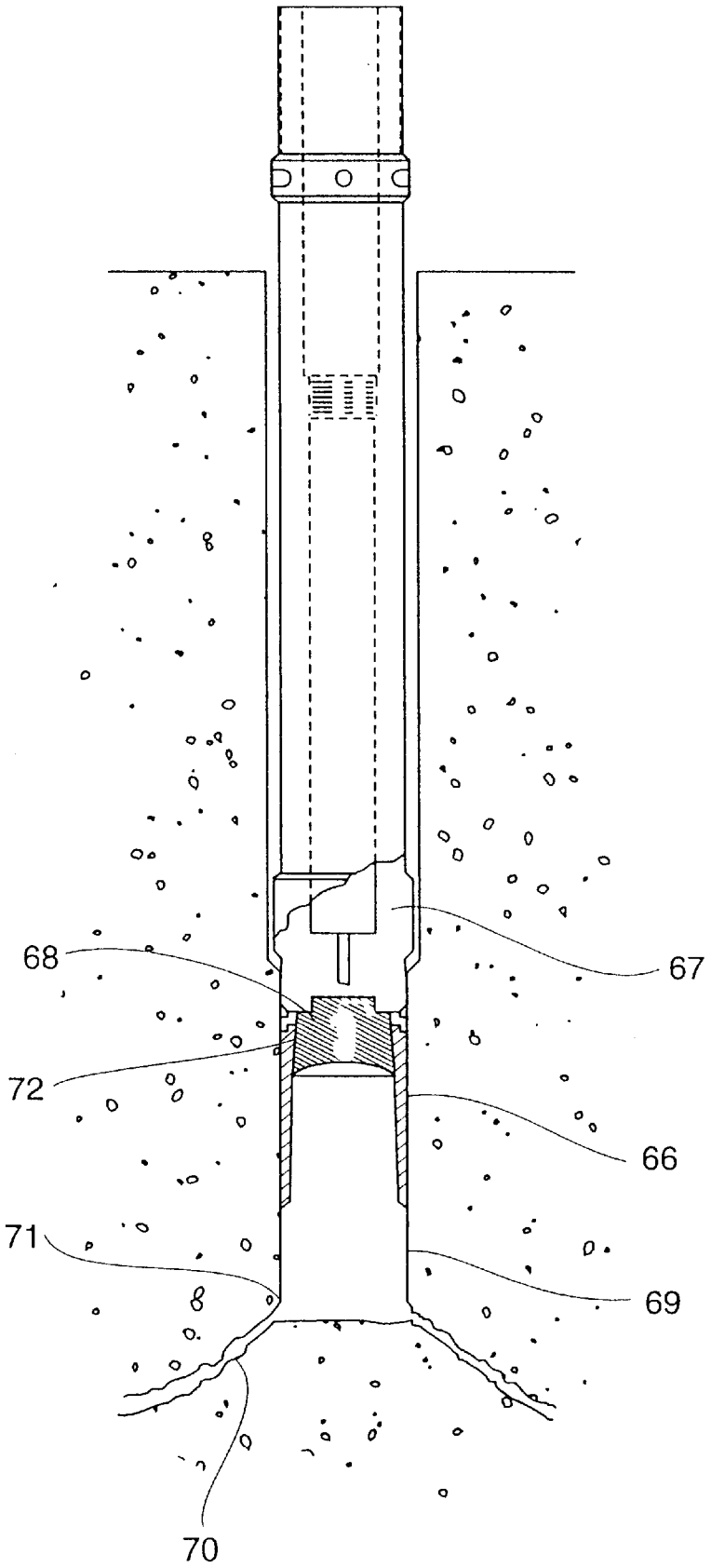
FIG. 8 is a cutaway view of the present SCB-EX process after the explosive has been detonated showing the sealing action by the recoiling base plug of the SCB-EX cartridge when the cartridge wall does not rupture near the end of the stemming bar.
Figure 9:
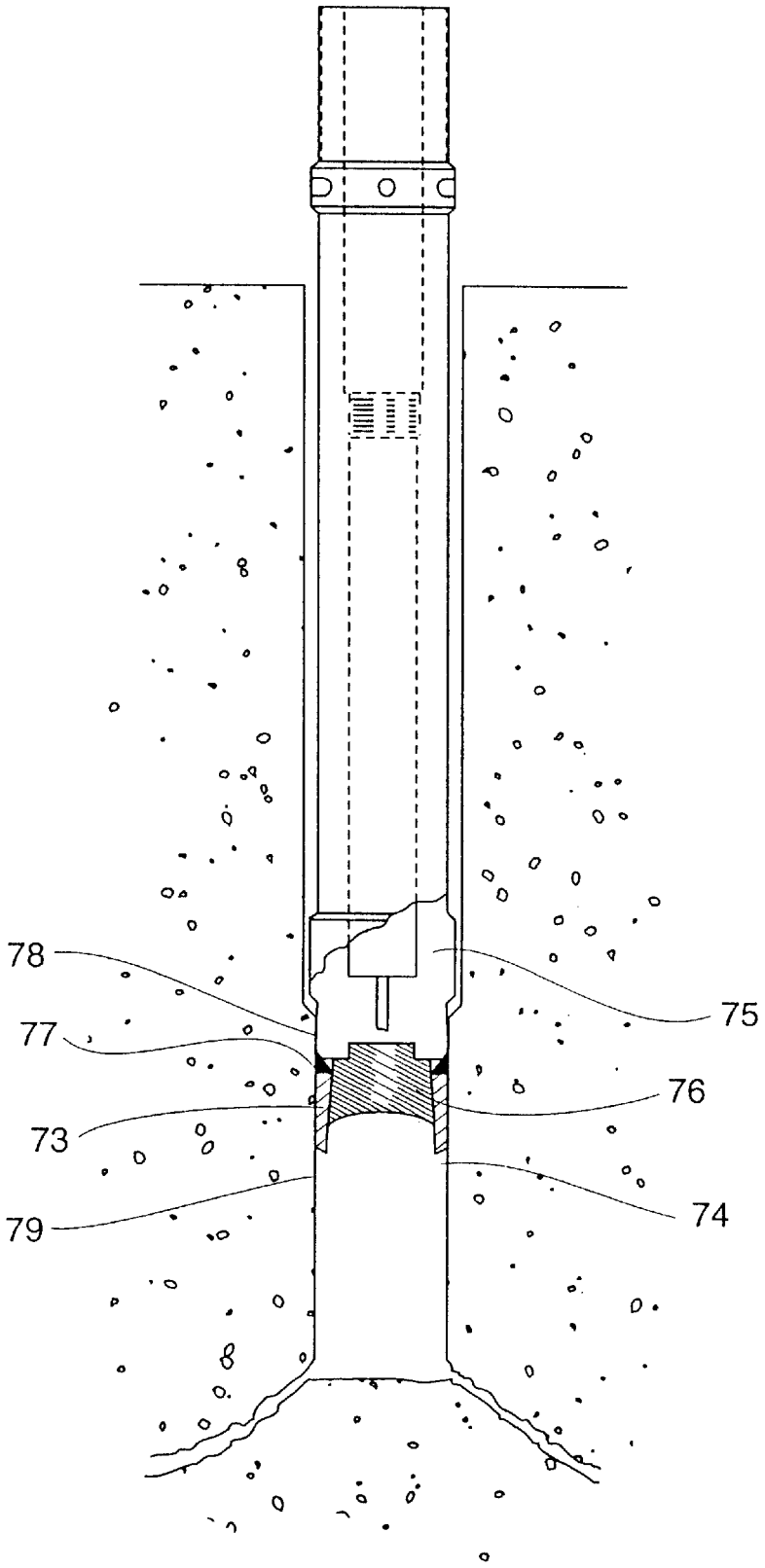
FIG. 9 is a cutaway view of the present SCB-EX process after the explosive has been initiated showing the sealing action by the back-up sealing ring when the cartridge wall does rupture near the end of the stemming bar.

FIGS. 3, 8 and 9 illustrate the SCB-EX process. FIG. 3 shows the system before detonating the explosive. Two possibilities are envisioned for the behavior of the rear of the cartridge. In the first case, shown in FIG. 8, the tapered base plug recoils with the stemming bar and the walls of the cartridge are held against the drill hole walls by the gas pressure. In this case, there is no leakage of explosive product gases out of the rear of the cartridge. The front end of the cartridge is fragmented, and the hole bottom is exposed to the full gas pressure. In the second case, shown in FIG. 9, the wall of the cartridge near the base plug has been ruptured. The high pressure gas has forced some of the wall material and the steel back-up ring into the gap between the stemming bar and the walls of the drill hole to seal any further leakage of gas past the stemming bar. In this case, the walls of the drill hole near the hole bottom are exposed to high-pressure gases, which may be advantageous in rock formations having numerous pre-existing fractures. Otherwise the operation of the system is the same as in FIG. 8.

Figure 10:
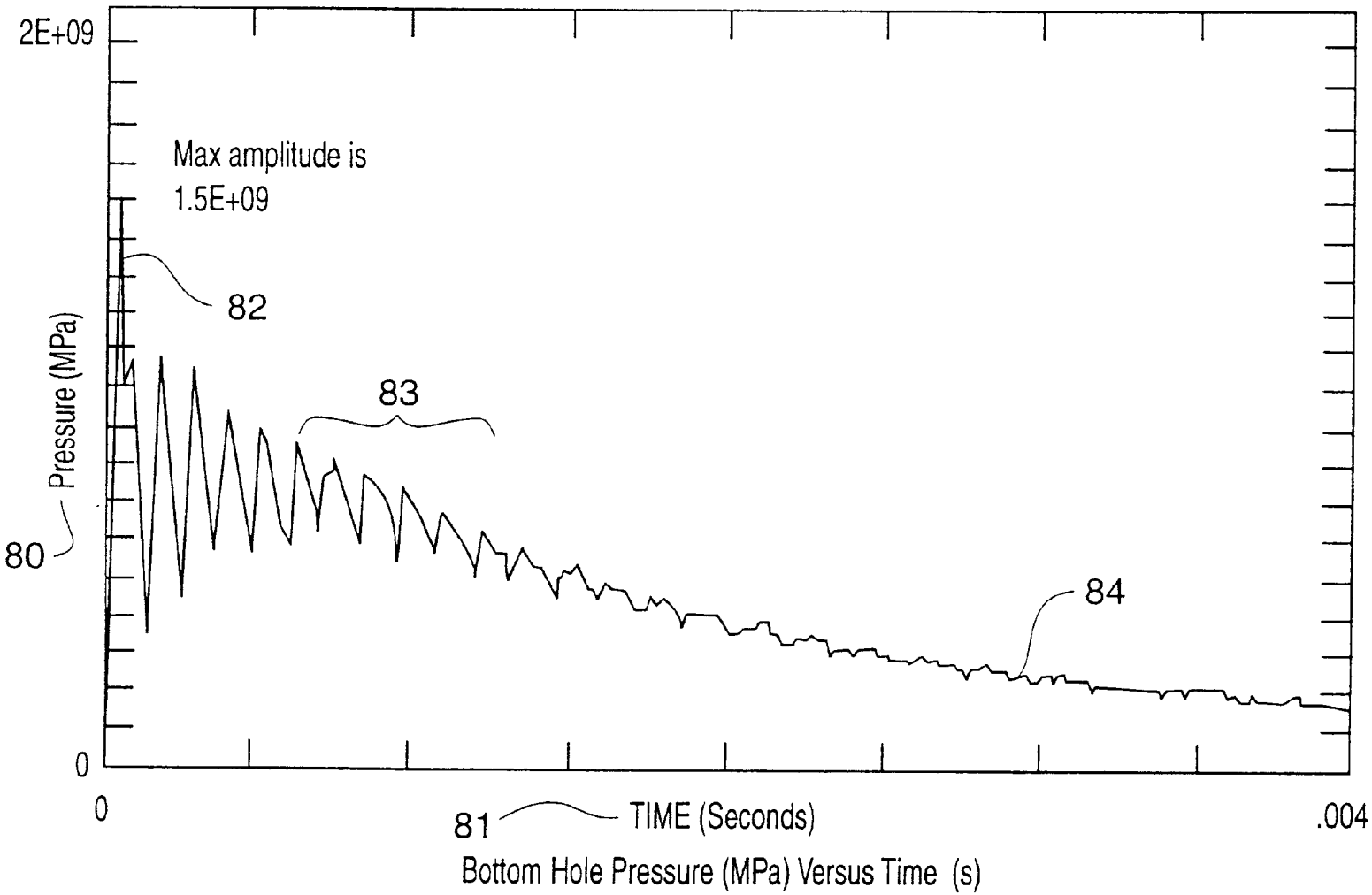
FIG. 10 illustrates the calculated pressure history at the hole bottom for the case when the rock does not break, typical of the SCB-EX method with the explosive charge initially decoupled from the hole bottom.

FIG. 10 illustrates the pressure history in the hole bottom as calculated using a finite difference computer code. This code models the detonating explosive in the cartridge, the recoil of the stemming bar, the leakage of gas past the stemming bar and the evolution of a typical fracture volume. FIG. 10 shows the hole bottom pressure for the case when the rock does not fracture, as might happen when the hole is drilled too deep. The calculation includes the recoil of the stemming bar and some gas leakage past the stemming bar. The calculation has been made for 200 grams of TNT explosive which is initially decoupled from the bottom of a 89-mm diameter drill hole. There is a moderate shock spike driven into the hole bottom by the explosive products rapidly expanding across the initial 30 mm gap that separates the charge from the hole bottom. The pressure at the hole bottom begins within 25 microseconds of initiation of the TNT and oscillates rapidly in the small volume available. Bar recoil and gas leakage cause the average pressure to decay over time.

Figure 11:
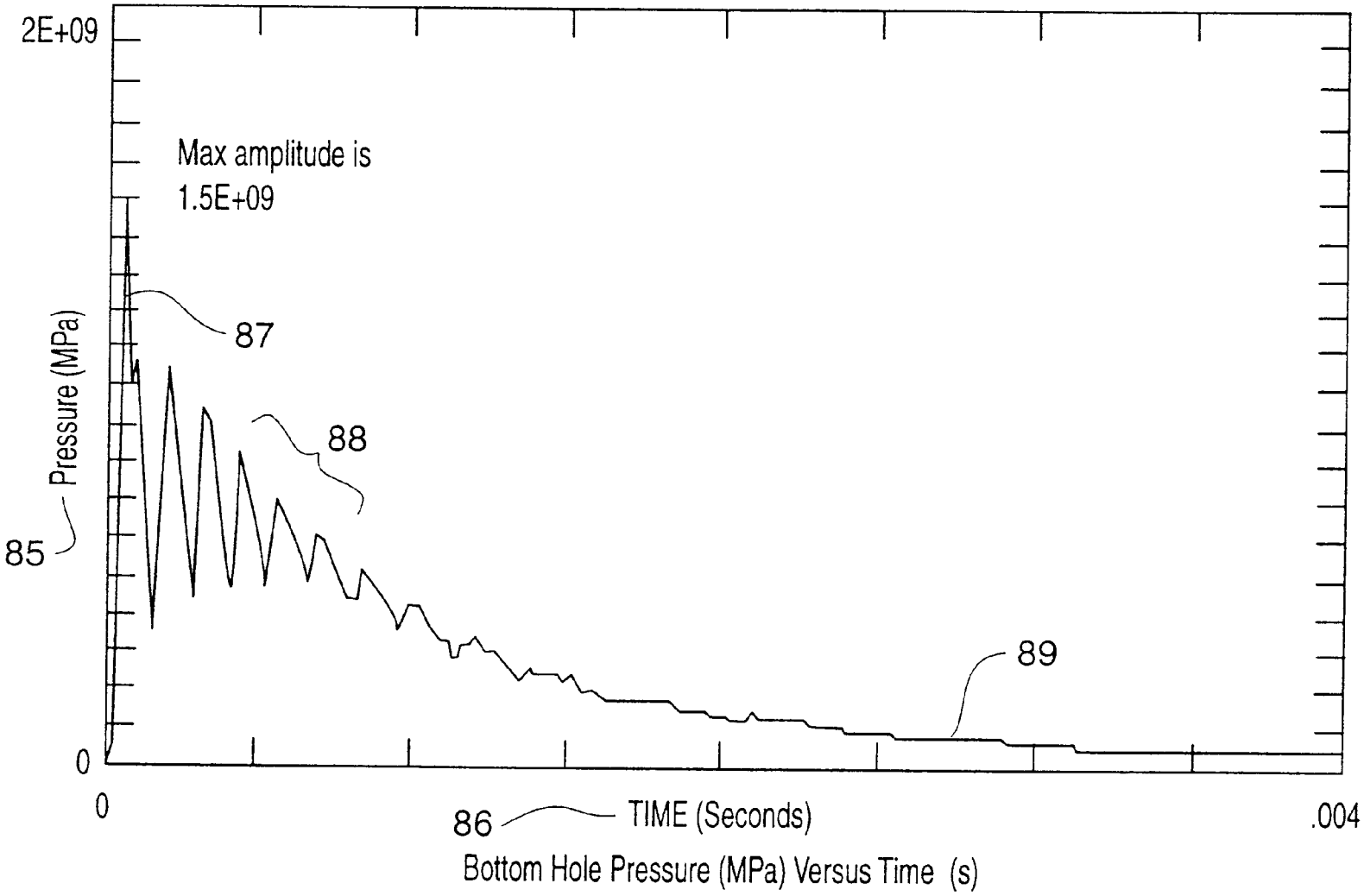
FIG. 11 illustrates the calculated pressure history at the hole bottom for the case when the rock breaks, typical of the SCB-EX method with the explosive charge initially decoupled from the hole bottom.

FIG. 11 shows the hole bottom pressure for the case of a de-coupled charge when the rock fractures. The calculation includes the recoil of the stemming bar, some gas leakage past the stemming bar and fracture volume opening up at the hole bottom. As compared to the pressure history of FIG. 10, the pressure in the hole bottom decays more rapidly in the latter part of the pressure history because of the evolving fracture volume into which the high-pressure gases flow.

Figure 12:
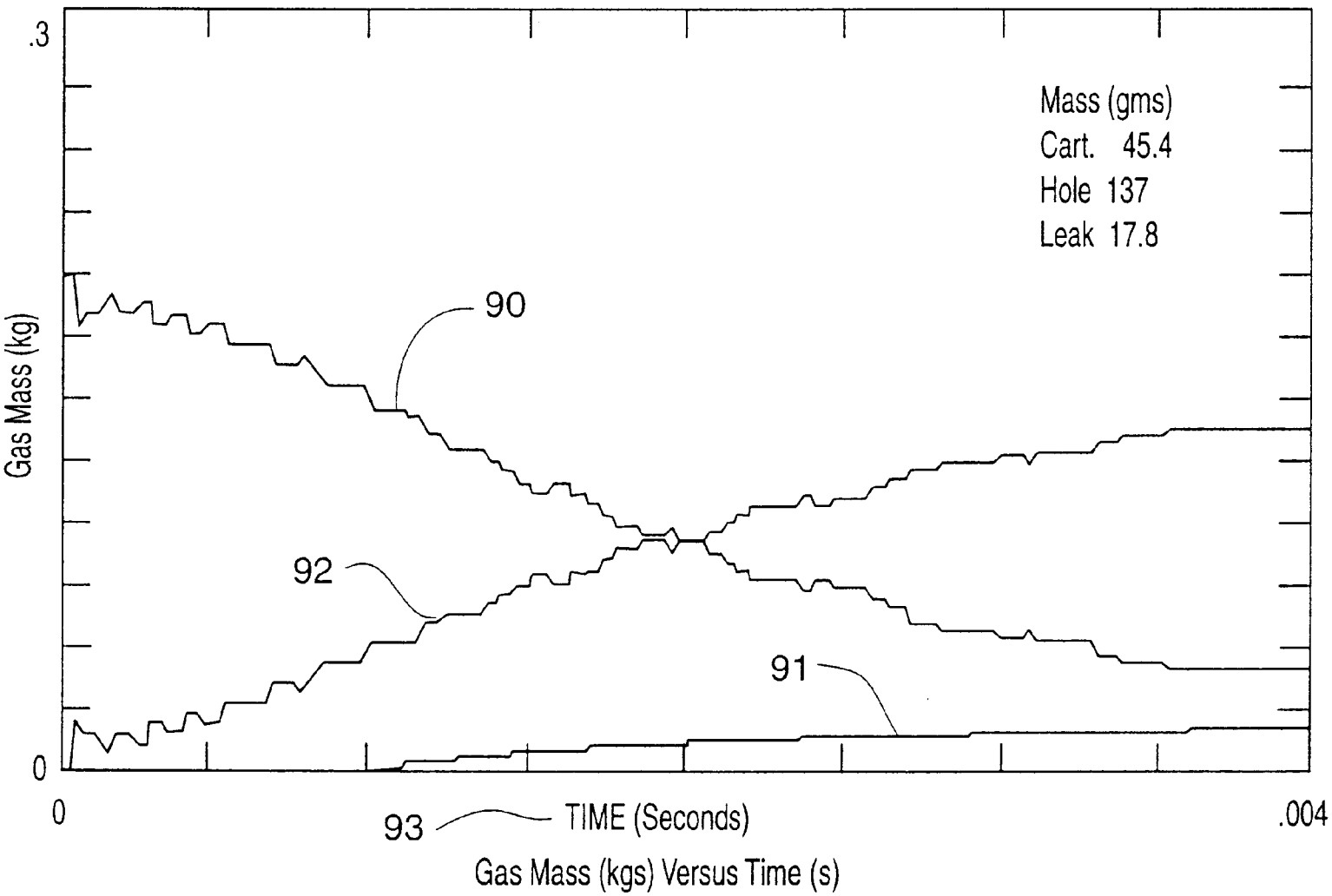
FIG. 12 illustrates the calculated gas distribution in the SCB-EX system for the case when the rock breaks where leakage occurs around the stemming bar while fracture volume is opened up.

FIG. 12 shows the gas distribution history for the case when the rock breaks. The distribution tracks the gas remaining within the cartridge volume, the gas leaked out of the base of the cartridge (assuming imperfect sealing action), and the gas injected into the hole bottom and the rock fractures. In this calculation, the base of the cartridge is assumed to have ruptured after 2.5 mm of recoil and the gas leaks out the gap between the stemming bar and the drill hole walls. After 4 milliseconds, 45 grams of gas remain within the original cartridge volume, 18 grams have leaked past the stemming bar and 137 grams have been injected into the hole bottom and developing fractures. After 4 milliseconds, the fracture has propagated over a meter and the rock has been effectively excavated. From the perspective of gas leakage, this is a worst case situation since the gap between the stemming bar and drill hole walls is assumed to be wide open and not blocked by any cartridge material or a back-up metal sealing ring.

Figure 13:
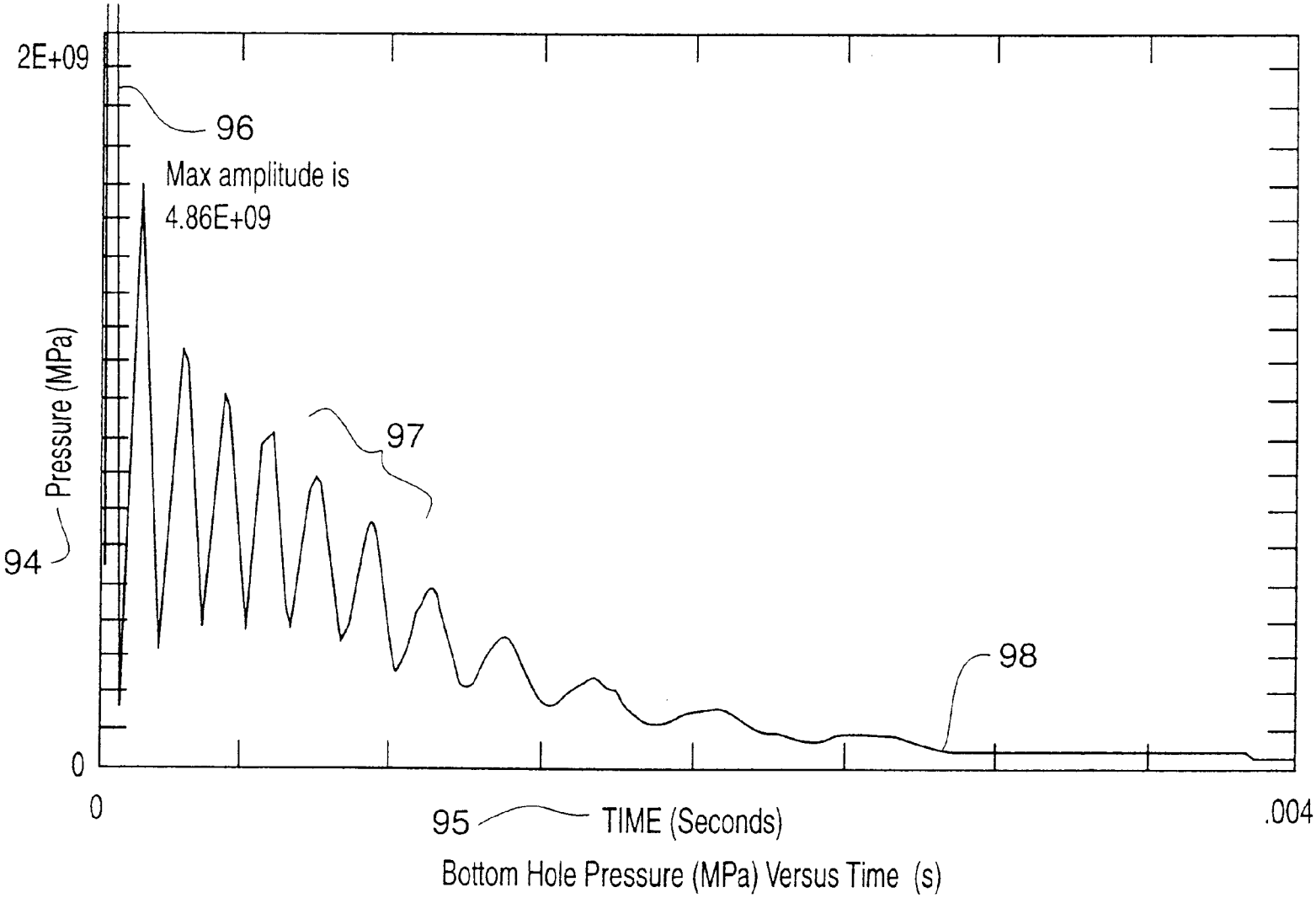
FIG. 13 illustrates the calculated pressure history at the hole bottom for the case when the rock breaks, typical of the SCB-EX method with the explosive charge initially coupled to the hole bottom to enhance microfracturing.

FIG. 13 shows the hole bottom pressure for the case of a coupled charge when the rock breaks. This illustrates a much stronger shock spike driven into the hole bottom. While there is little energy associated with this pulse, the effect is to create microfractures at the hole bottom. The initial shock spike in this case would be expected to create substantially more microfracturing than the case depicted in FIG. 11.

Figure 14:
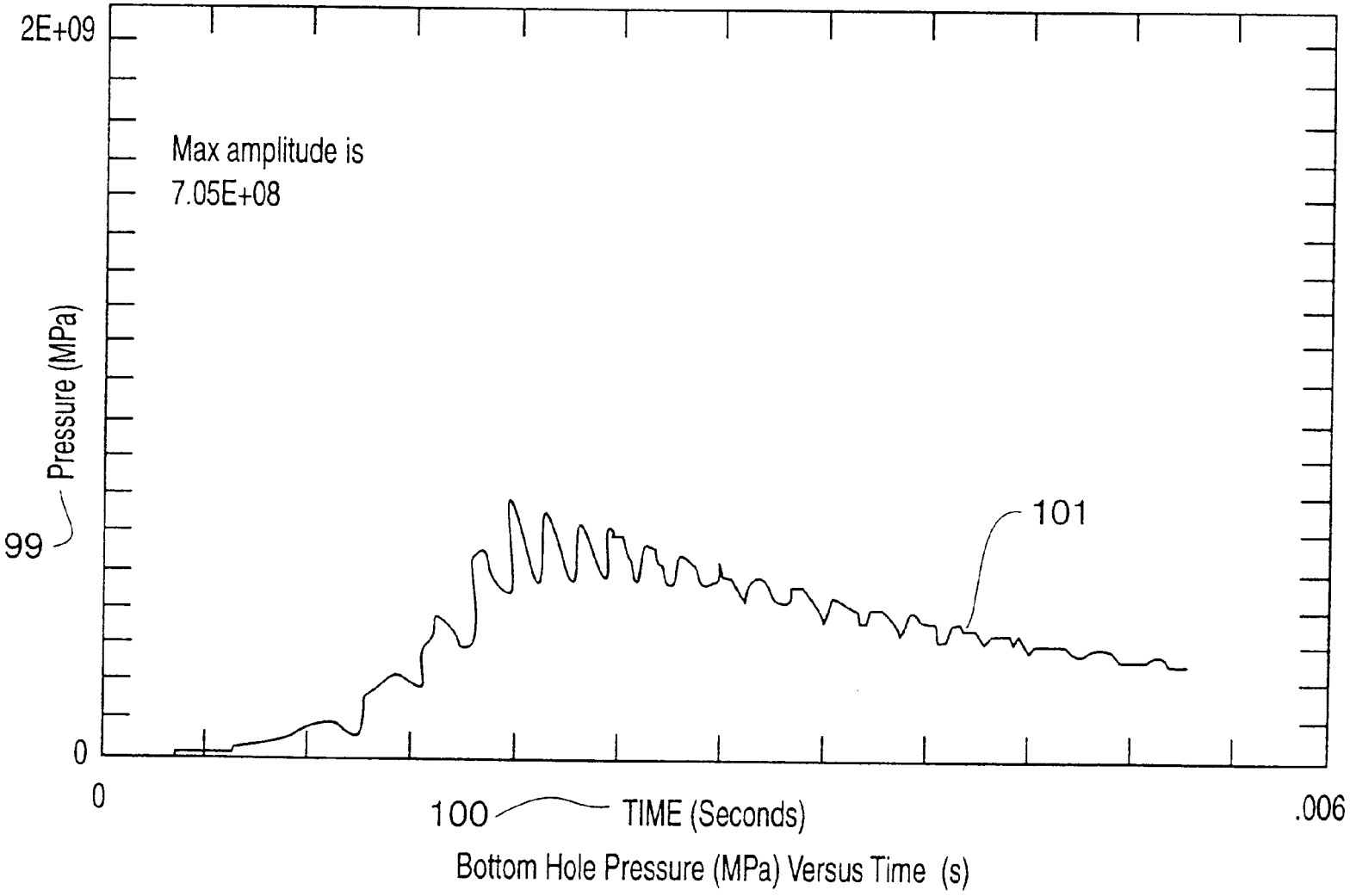
FIG. 14 illustrates the calculated pressure history at the hole bottom for the case when the rock does not break, typical of the propellant-based Charge-in-the-Hole method.

FIG. 14 shows the hole bottom pressure history for the case of a propellant based Charge-in-the-Hole system such as embodied in U.S. Pat. No. 5,308,149 entitled "Non-Explosive Drill Hole Pressurization Method and Apparatus for Controlled Fragmentation of Hard Compact Rock and Concrete". The calculation has been made for 250 grams of fast-burning propellant in the same hole volume as used for the preceding SCB-EX calculations. This pressure history can be compared directly to the SCB-EX pressure history shown in FIG. 10 where the rock does not break and bar recoil and gas leakage cause the average pressure to decay over time. The principal difference is the relatively slow rate at which pressure builds up and the absence of any strong shock spike in the propellant example. In the propellant case, there is substantially more recoil of the stemming bar before pressures build up to the threshold where fractures begin to initiate.

Figure 15:
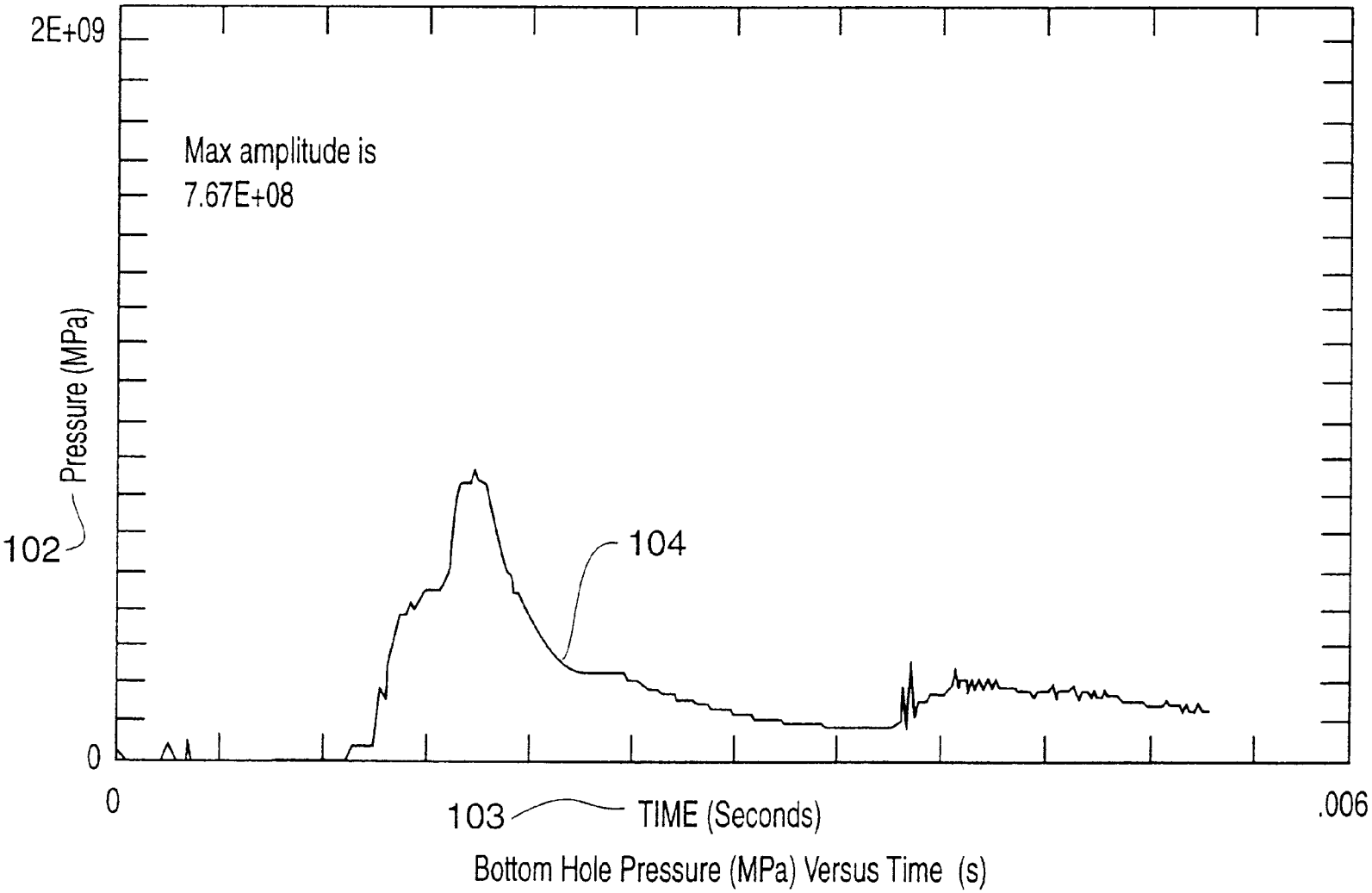
FIG. 15 illustrates the calculated pressure history at the hole bottom for the case when the rock does not break, typical of the propellant-based Gas Injector method.

FIG. 15 shows the hole bottom pressure history for the case of a propellant based Injector system such as embodied in U.S. Pat. No. 5,098,163 entitled "Controlled Fracture Method and Apparatus for Breaking Hard Compact Rock and Concrete Materials". The calculation has been made for 380 grams of fast-burning propellant in the combustion chamber of the gas-injector. The same bottom hole volume is used as used for the preceding SCB-EX calculations. This pressure history can be compared directly to the SCB-EX pressure history shown in FIG. 10 where the rock does not break and bar recoil and gas leakage cause the average pressure to decay over time. The principal difference is the gas injected into the hole bottom blows back up the barrel of the gas-injector and causes a rapid loss of pressure at the hole bottom even when the rock does not break. In the Injector method, the propellant gases developed in the combustion chamber must expand down the injector barrel to reach the bottom of the drill hole. When the high-velocity gases encounter the bottom of the hole, kinetic energy is abruptly converted back to internal energy and the gas pressure rises abruptly. The pressure wave reflects back into the injector which, in effect, represents a "major leak" to the maintaining of pressure in the hole bottom. There is also an absence of any strong shock spike in the propellant example.

Figure 16:
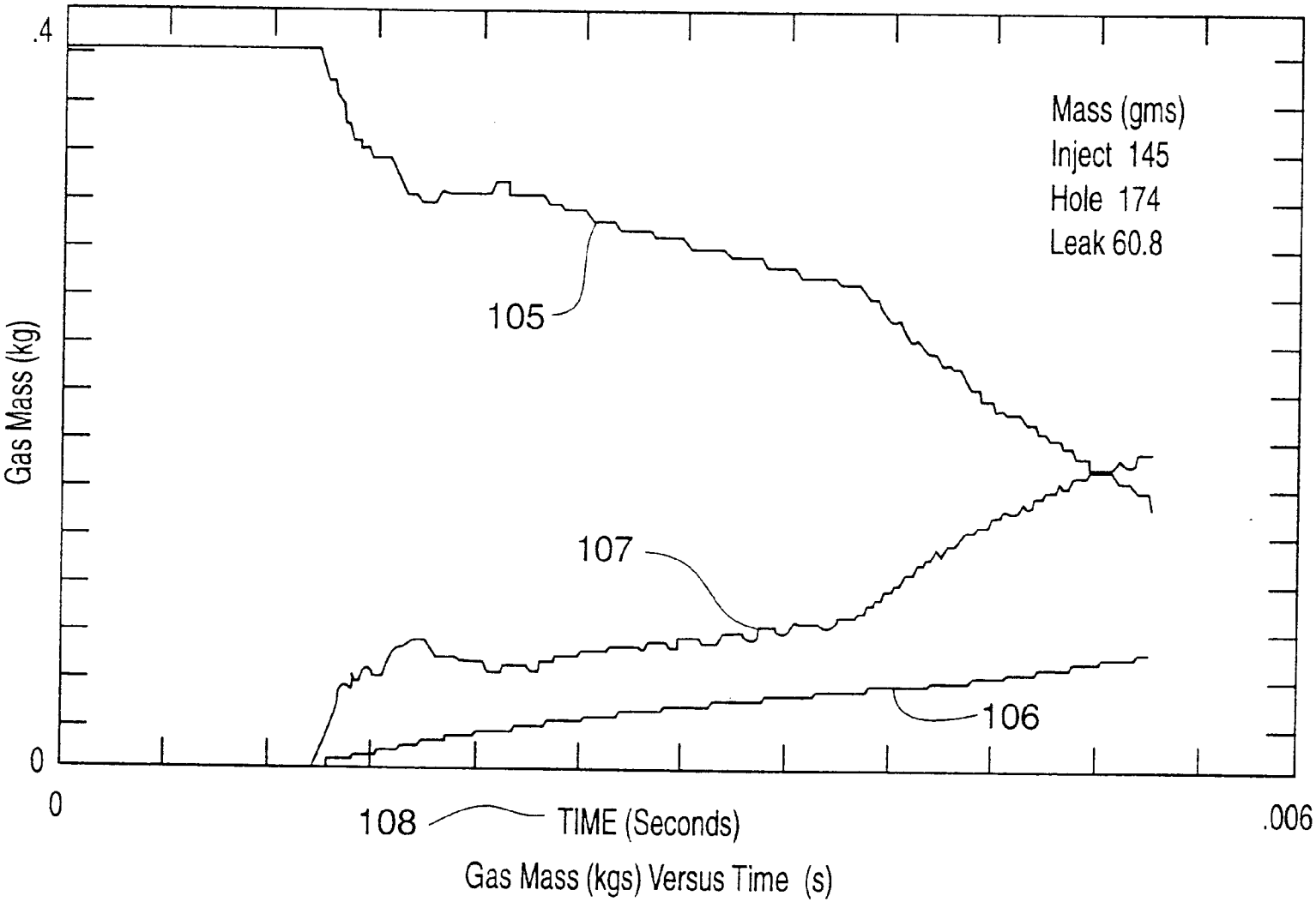
FIG. 16 illustrates the calculated gas distribution in the propellant-based Gas Injector system for the case when the rock breaks where gas leakage occurs past the basrrel tip while fracture volume is opened up.

FIG. 16 shows the gas distribution history for the Injector case when the rock breaks. The distribution tracks the gas remaining within the gas-injector volume, the gas leaked out of the hole bottom past the seal at the muzzle of the barrel, and the gas injected into the hole bottom and the rock fractures. After 4 milliseconds of pressure on the hole bottom, 145 grams of gas remain within the gas-injector volume, 61 grams have leaked out of the hole volume and 174 grams have been injected into the hole bottom and developing fractures. By this time the fractures have been propagated to the surface and the rock has been effectively fragmented. The principal observation is that 145 grams of the initial 380 grams of propellant gases remain in the gas-injector after fragmentation of the rock has been completed. This gas then must empty out of the gas-injector and is a principal source of noise and fly-rock energization.

A good comparison of the Injector, CIH and SCB-HE methods may be made by evaluating the integrated pressure history (impulse) at the bottom of the drill hole in the case where the rock does not fracture. In this comparison, recoil of a stemming bar (mass of 772 kilograms) and gas leakage are included but no evolution of fracture volume is allowed. The impulse is computed for the pressure acting on the hole bottom for the same time duration (about 4 milliseconds). The results are shown in Table 1. It is seen that the CIH and SCB-HE methods deliver about the same impulse to the hole bottom and leak comparable amounts of gas. The SCB-HE process achieves this with 50 grams less charge, primarily as a consequence of the higher ratio of specific heats of the explosive products (y=1.3) compared to the propellant products (y=1.22) . The Injector method delivers significantly less impulse with a substantially greater charge mass. The calculations were repeated, this time allowing the rock to fracture and evolve fracture volume. The results are shown in Table 2. The fracture volume model used herein assumes that the fracture propagates at a constant velocity (350 m/s) once the fracture initiation threshold is exceeded. Thus the fracture propagates about 1.25 meters in the 4 milliseconds that the pressure is applied and this is considered sufficient to complete the rock fragmentation process.

The effect of the shock spike generated in the SCB-HE method on rock fracturing is not included in the calculations. However, the peak amplitude and short duration of this shock spike in the HE-coupled case is in the proper range to induce substantial microfracturing in the region directly below the hole bottom.

Features

The primary features of the SCB-EX method are:

1. Pressurizing only the hole bottom with pressures high enough to break hard rock.
2. The controlled use of detonating explosives as an energy source.
3. A means of dynamic sealing of the hole bottom until the rock breaks.
4. A means of creating microfractures at the hole bottom only A key feature of the small-charge, controlled fracturing method is the benign nature of the flyrock which allows drilling, mucking, ground support and haulage equipment to remain at the working face during rock breaking operations. A second key feature of the method and apparatus is that they may be used in either dry or water filled holes.

An important feature of the SCB-EX process is the elimination of crushed rock which is a primary source of dust. Excess dust requires additional equipment and time to control and can, in some types of excavation operations, lead to secondary explosions which are a safety hazard. In the configuration shown in FIG. 3, the only portion of the drill hole exposed to direct detonation pressures is the hole bottom itself which represents only a small portion of the total hole surface area.

Components of the System

Figure 17:
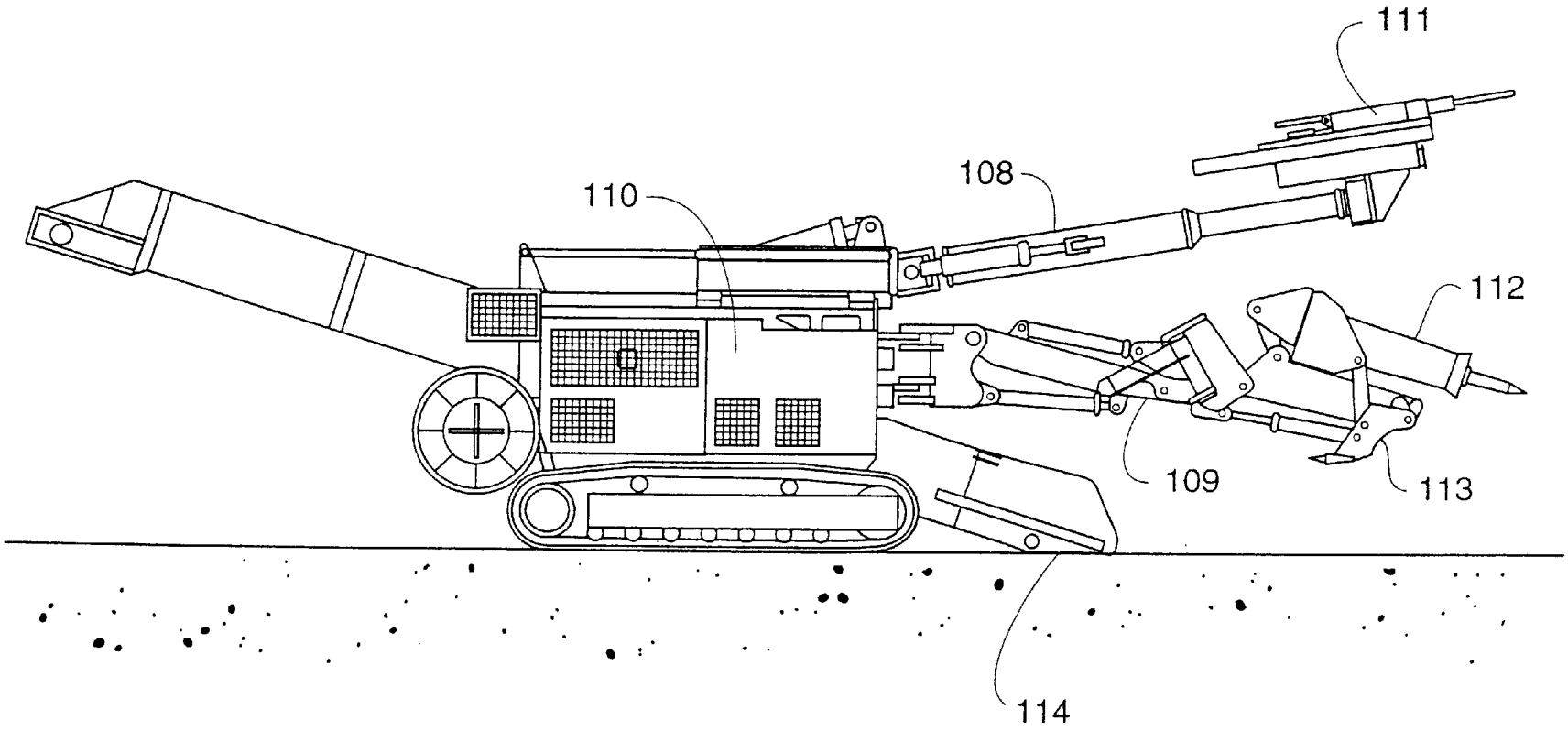
FIG. 17 shows the present invention in use with a typical carrier having a boom for the small-charge blasting apparatus. The small-charge blasting apparatus includes a means for drilling a short hole in the rock; indexing; inserting an SCB-EX cartridge into the hole; and firing the shot.

The basic components of the SCB-EX system are:

boom assembly and carrier drill mounted on the boom assembly the cartridge magazine and loading mechanism the stemming bar and explosive ignition mechanism the cartridge and blasting cap the main explosive charge The basic components of the SCB-EX excavation system are shown schematically in FIG. 17. The following paragraphs describe the envisioned characteristics of the various components.

The Boom Assembly and Undercarrier

The carrier may be any standard mining or construction carrier or any specially designed carrier for mounting the boom assembly or boom assemblies. Special carriers for shaft sinking, stope mining, narrow vein mining and military operations, such as trenching, fighting position construction and demolition charge placement, may be built.

The boom assembly may be comprised of any standard mining or construction articulated boom or any modified or customized boom. The function of the boom assembly is to orient and locate the drill and SCB-EX device to the desired location. The boom assembly may be used to mount an indexer assembly. The indexer holds both the rock drill and the SCB-EX stemming bar assembly and rotates about an axis aligned with both the rock drill and the SCB-EX stemming assembly. After the rock drill drills a short hole in the rock face, the indexer is rotated to align the stemming bar assembly for ready insertion into the drill hole. The indexer assembly removes the need for separate booms for the rock drill and the stemming bar assembly. The mass of the boom and indexer also serves to provide recoil mass and stability for the drill and SCB-EX device.

The Rock Drill

The drill consists of the drill motor, drill steel and drill bit, and the drill motor may be pneumatically or hydraulically powered.

The preferred drill type is a percussive drill because a percussive drill creates micro-fractures at the bottom of the drill hole which act as initiation points for penetrating-cone fracture. Rotary, diamond or other mechanical drills may be used also. In these cases the bottom of the hole may have to be specially conditioned to promote the PCF type of fracture. Standard drill steels can be used and these can be shortened to meet the short hole requirements of the SCB-EX method.

Standard mining or construction drill bits can be used to drill the holes. Percussive drill bits that enhance microfracturing may be developed. Drill hole sizes may range from 1-inch to 20-inches in diameter and depths are typically 3 to 15 hole diameters deep.

Drill bits to form a stepped hole for easier insertion of the stemming bar assembly may consist of a pilot bit with a slightly larger diameter reamer bit, which is a standard bit configuration offered by manufacturers of rock drill bits. Drill bits to form a tapered transition hole for easier insertion of the stemming bar assembly may consist of a pilot bit with a slightly larger diameter reamer bit. The reamer and pilot may be specially designed to provide a tapered transition from the larger reamed hole to the smaller pilot hole.

For the stemming bar configuration in which the transition from the reamed hole to the pilot hole is tapered, the angle of the tapered section of the stemming bar ranges preferably from about 10 degrees to 45 degrees, more preferably from about 15 degrees to 40 degrees and most preferably from about 15 degrees to 30 degrees.

SCB-EX Cartridge Magazine and Loading Mechanism

The SCB-EX cartridges are stored in a magazine in the manner of an ammunition magazine for an autoloaded gun. The loading mechanism is a standard mechanical device that retrieves a cartridge from the magazine and inserts it into the drill hole. The stemming bar described below may be used, as a sub-component of the loading mechanism, to insert the cartridge into the drill hole.

The loading mechanism will have to cycle a cartridge from the magazine to the drill hole in no less than 10 seconds and more typically in 30 seconds or more. This is slow compared to modern high firing-rate gun autoloaders and therefore does not involve high-acceleration loads on the SCB-EX explosive cartridge. Variants of military autoloading techniques or of industrial bottle and container handling systems may be used.

The average time between sequential small-charge blasting shots ranges preferably from about 0.5 minutes to 10 minutes, more preferably from about 1 minute to 6 minutes and most preferably from about 1 minute to 3 minutes. The loading mechanism will be required to move a cartridge from the magazine to insertion in the drill hole in a time less than the above shot cycling time.

One variant is a pneumatic conveyance system in which the cartridge is propelled through a rigid or a flexible tube by pressure differences on the order of 1/10 bar.

The Stemming Bar and Firing Mechanism

This is a major component of the present invention. It is a reusable component that provides inertial confinement for the high-pressure explosive product gases and provides primary sealing of the gases in the hole bottom by blocking off most of the cross-sectional area of the hole. The stemming bar can be made from a high-strength steel with good fracture toughness characteristics. It can also be made from other materials that combine high density and mass for inertia, strength to withstand the pressure loads without deformation and toughness for durability. Alternately, a high-strength steel stemming bar with a non-metallic end section can be employed. This end section can be made from a high-impact material such as urethane to help isolate the main stemming bar from occasional high-pressure overloads.

The stemming bar is attached to the main indexing boom mechanism as illustrated in FIG. 17. The stemming bar typically extends well into the drill hole. The stemming bar makes firm contact with the explosive containing cartridge to provide close proximity for the electric blasting cap or other explosive initiating method and to confine the cartridge at the bottom of the drill hole as the explosive is detonated. The diameter of the stemming bar is just less than the drill hole diameter, enough to provide clearance for the bar in the hole. The stemming bar contains the firing mechanism for the explosive cartridge. This firing mechanism may be electrical or optical in function.

Additional sealing against the escape of the explosive product gases may be provided at the cartridge end of the stemming bar. Any of several conventional sealing techniques, such as V-seals, O-rings, unsupported area seals et cetera, may be employed. The additional sealing would serve to further limit the undesirable escape of explosive product gases from the cartridge and the bottom of the hole. Additional sealing of the explosive product gases may be achieved also by accelerating the stemming bar into the hole just prior to ignition of the explosive charge such that the inertia of the stemming bar into the hole provides additional forces against the displacement of the cartridge out of the hole and the consequent cartridge rupture and loss of high-pressure explosive product gases.

The SCB-EX Cartridge and Initiator

The SCB-EX cartridge is a major component of the present invention. Its function is to:

- a act as a storage container for the solid or liquid explosive
- to serve as a means of transporting the explosive from the storage magazine to the excavation site
- to protect the explosive charge during insertion into the drill hole
- to serve as a combustion chamber for the explosive
- to provide internal volume to control the pressures developed in the hole bottom
- to protect the explosive charge from water in a wet drill hole
- to provide the stemming bar with isolation from any strong shock transients from the explosive charge.
- to provide a backup sealing mechanism for the explosive product gases as the explosive is detonated in the drill hole.

In addition to containing the explosive charge, the SCB-EX cartridge as illustrated in FIGS. 4, 5 and 6 contains excess internal volume to control the average pressure in the cartridge to the desired level which may be substantially less than if the total cartridge volume were filled with solid or liquid explosive.

One of the main design criteria for the cartridge is to provide proper sealing in the drill hole for the detonating or explosive product gases under controlled conditions. The cartridge may be designed to seal adjacent to the stemming bar, around the drill hole walls. This will prevent high-pressure gases from leaking between the stemming bar and the walls of the drill hole, and better contain the high-pressure explosive product gases in the bottom of the drill hole. A simple cartridge design with features to ensure proper drill hole sealing and containment of the explosive product gases is shown in FIG. 4. The SCB-EX cartridge must have a combination of the proper geometry and the proper material properties to prevent premature cartridge rupture, which results in the premature loss of propellant gas pressure, which, in turn, reduces the effectiveness of the desired hole-bottom controlled-fracture process. The cartridge design illustrated in FIG. 4 satisfies the general requirements by combining a tapered wall and similarly tapered base plug, both of which tend to prevent the premature failure of the cartridge near the cartridge base. Wall tapers in the range of 1 to 10 degrees are satisfactory, with tapers between 3 and 5 degrees being preferred.

The cartridge may be made from any tough and pliable material, including most plastics, metals, and properly constructed composites. The cartridge must be made of a material which can deform either elastically and/or plastically, with sufficient deformation prior to rupture to allow the cartridge containment to follow both the expansion of the drill hole walls and the recoil of the stemming bar during the rapid drill hole pressurization and controlled-fracture process. The cartridge may also be made from a combustible or consumable material such as used in combustible cartridges occasionally used in gun ammunition. The preferred materials are those that will provide the required sealing and that can be made for the lowest cost per part.

In the design shown in FIG. 4, a mechanical action is used to reduce some of the geometry and material property requirements of the first cartridge design. This SCB-EX cartridge is constructed of a pliable sleeve and basal sealing plug. The pliable sleeve is tapered to provide a greater resistance to premature rupturing of the cartridge near its base and to provide an interference seal with the basal sealing plug, which is also tapered. The basal sealing plug can be constructed from any solid material, such as a plastic, a metal or a composite. The preferred materials are those that can be made for the lowest cost per part. The basal sealing plug contains the blasting cap or other initiator required to detonate the explosive charge.

The blasting cap is located in the cartridge at the end adjacent to the stemming bar. Its function is to initiate a detonation in the main explosive charge when actuated by a command from the operator. Standard or novel explosive initiation techniques may be employed. These include instantaneous electric blasting caps fired by a direct current pulse or an inductively induced current pulse; non-electric blasting caps; thermalite; high-energy primers or an optical detonator, where a laser pulse initiates a light sensitive primer charge.

An alternate cartridge design is shown in FIG. 6. This cartridge design is similar in construction to the cartridge design shown in FIG. 4. This alternate design satisfies the general sealing requirements by providing a base that is driven into the gap between the stemming bar and the rock under the action of the explosive gas products. The base also includes a means of shock isolation to protect the end of the stemming bar from shock transients from the detonating explosive. As with the other SCB-EX cartridge designs, the means for initiating the explosive is contained in the base of the cartridge.

The explosive charge is loaded into a plastic, metallic or heavy paper container which is mounted inside the cartridge to give the explosive charge rigidity and to position it within the cartridge so as to decouple the explosive from the walls of the drill hole.

The Explosive

Explosives rather than propellants are employed in the present invention. Propellants deflagrate or burn subsonically and pressure build-up is controlled by the propellant geometry; propellant chemistry; propellant loading density; ullage or empty space in the cartridge; and confinement of the cartridge/propellant system between the walls of the drill hole and the stemming bar. With this control, the bottom of the drill hole can be pressurized until a penetrating cone fracture or other controlled fractures are initiated along the line of maximum stress concentration on the perimeter of the hole bottom. The propellant gases then expand into the fracture(s) and drive the fracture(s) deep into the rock and/or to nearby free surfaces.

An explosive charge, on the other hand, detonates which is a supersonic type of burning that generates strong shock waves. These shock waves can be controlled and directed to pressurize the bottom of the drill hole in a controlled manner so that the rock around the drill hole would not be excessively fractured and crushed. By restricting the mass of explosive, it is possible to achieve a desired average pressure in the bottom hole volume. By configuring the geometry of the explosive charge, strong shock waves can be prevented from engaging the walls of the hole bottom or directed at the bottom of the hole to induce microfractures where they can act as initiation sites for the main fracture.

The explosives that would be used in the present invention may be solid, liquid or slurried in form. Examples of solid explosives are:

dynamites ammonium nitrate

TNT

Composition 3

Composition 4

Octol

Examples of liquid explosives are:

nitromethane hydrazine

Examples of slurried explosives are:

ammonium nitrate/fuel oil water gels emulsions slurries mixtures of ammonium nitrate and nitromethane The explosive may be sensitized so that it is "cap sensitive" (able to be initiated by a number 8 blasting cap) either when it is shipped or just prior to use by injecting sensitizer into the explosive.

The explosive may also have a agents added to reduce the amount of toxic by-products generated during combustion.

APPLICATIONS

This method of breaking soft, medium and hard rock as well as concrete has many applications in the mining, construction and rock quarrying industries and military operations. These include:

tunneling cavern excavation shaft-sinking adit and drift development in mining long wall mining room and pillar mining stoping methods (shrinkage, cut & fill and narrow-vein)

selective mining undercut development for vertical crater retreat (VCR) mining draw-point development for block caving and shrinkage stoping secondary breakage and reduction of oversize trenching raise-boring rock cuts precision blasting demolition open pit bench cleanup open pit bench blasting boulder breaking and benching in rock quarries construction of fighting positions and personnel shelters in rock reduction of natural and man-made obstacles to military movement The general Penetrating Cone Fracture (PCF) breakage mechanism for a small-charge blasting method using a stemming bar to inertially contain a cartridge containing an explosive charge in the bottom of a short drill hole is shown schematically in FIG. 1. A cartridge 1 is inserted in the bottom of a short drill hole 2 drilled into the rock face 3. An inertial stemming bar 4 is placed in the hole to contain the high-pressure gases generated by a small explosive charge contained in cartridge 1. The gases fill the volume 5 and pressurize the bottom of the hole 2 until a PCF type of fracture 6 is driven down into the rock 7. The fracture 6 curves upwards toward the rock face 3 and when the fracture 6 intersects the rock face 3, the rock bounded by the fracture 6 and rock face 3 is effectively fragmented.

An alternate breakage mechanism for a small-charge blasting method using a stemming bar to inertially contain a cartridge containing an explosive charge in the bottom of a short drill hole is shown schematically in FIG. 1. A cartridge 8 is inserted in the bottom of a short drill hole 9 drilled into the rock face 10. An inertial stemming bar 11 is placed in the hole to contain the high-pressure gases generated by a small explosive charge contained in cartridge 8. The gases fill the volume 12 and pressurize the bottom of the hole 9 until pre-existing fractures 13 are further extended into the rock 14. The fractures 13 curve upwards toward the rock face 10 and when the fractures 13 intersect the rock face 10, the rock bounded by the fractures 13 and rock face 10 is effectively fragmented.

FIG. 3 shows the SCB-EX system positioned in a drill hole prior to firing. A short hole 15 is drilled into the rock face 16 and a cartridge 17 is inserted into the bottom of the hole 15. The cartridge 17 may be inserted by attaching it to the end of a stemming bar 18 which is prevented from crushing the cartridge 17 by stopping at the step 19 formed near the bottom of the drill hole 15. The cartridge base 20 is attached to the end of the stemming bar 18 and may recoil with the stemming bar 18 under the action of the high-pressure gases generated by the explosive charge 21. An explosive initiation system 22 is located coaxially in the stemming bar and is used to initiate the blasting cap 23 located in the base 20 of the cartridge 17. A tube 24 contains the explosive charge 21 within the cartridge 17. Because the cartridge 17 contains excess volume 25, the SCB-EX method may be used in either a gas-filled or a water filled hole. In a water-filled hole, the cartridge 17 will displace most of the water from the bottom of the hole 15. In this configuration, the explosive charge 21 is coupled directly to the bottom of the cartridge 17 in order to drive a strong shock spike into the rock 26 at the bottom of the hole 15 to enhance microfracturing at the bottom of the hole 15. For best results, at least about 50% of the area of the nose portion of the outer cartridge housing that contacts the bottom of the hole contacts the explosive. The preferred contact area is the outer annulus of the nose portion so as to best induce microfracturing in the hole bottom in the annular region around the corner of the hole bottom.

FIG. 4 shows an SCB-EX cartridge 27 positioned at the bottom of a drill hole 28 and held by a stemming bar 29. The stemming bar 29 is prevented from crushing the cartridge 27 by a step 30 in the drill hole. The cartridge 27 is comprised of a body 31 and a tapered base plug 32 and a back-up metallic sealing ring 33. The base 32 of the cartridge 27 has a concave rear surface 34 to help locate the stemming bar 29 to maintain an approximate central alignment. An explosive charge 35 is held centrally in the base 32 of the cartridge 27. The explosive charge 35 does not completely fill the cartridge 27. The cartridge 27 also contains an internal volume 36 which allows the explosive combustion products to expand and control the average pressure in the cartridge 27. The explosive charge 35 is further contained in a skin or container 37 to give the explosive charge 35 structural support. The explosive charge 35 is coupled closely to the bottom of the cartridge body 31 so as to drive a strong shock spike into the bottom of the drill hole 38. The base 32 contains an electrical coil 39 which is connected to a blasting cap 40 which is used to initiate the explosive charge 35. A second electrical coil 41 is contained in the stemming bar 29 and is connected to an external firing circuit (not shown). A current pulse is generated in coil 41 and induces a current in coil 39 which is sufficient to initiate the blasting cap 40. Thus the stemming bar 29 does not need to be in intimate contact with the cartridge base 32.

FIG. 5 shows an SCB-EX cartridge 43 containing an explosive charge 44 that is not closely coupled to the bottom of the cartridge body 45 but separated by a gap 46. The gap 46 substantially reduces the peak pressure of the shock spike driven into the hole bottom 47. Otherwise, the cartridge 43 is substantially the same as the cartridge shown in FIG. 4. The stemming bar 48 is shown with a step 49 to prevent the stemming bar 48 from crushing the cartridge 43. The end of the stemming bar 48 is convex 50 to help it align with the concave base 51 of the cartridge. The primary means of sealing the gases generated by the explosive charge 44 is the end stemming bar 48 which fills most of the cross section of the bottom of the drill hole 52, leaving only a clearance gap 53 for the high-pressure gases to escape. Further sealing of these high-pressure gases is accomplished by the metallic sealing ring 54 and portions of the cartridge body 45 and cartridge base 55 that are forced into the gap 53 by the high-pressure gases.

FIG. 6 shows an alternate version of an SCB-EX cartridge 56 which incorporates a shock isolation mechanism 57 which is designed to help decouple the shock transient generated by the explosive charge 58, from the base plug 59 of the cartridge 56. Otherwise, the cartridge 56 is substantially the same as the cartridges shown in FIGS. 4 and 5.

FIG. 7 shows an alternate configuration of the down hole end of the stemming bar. A cartridge is not shown. The stemming bar 60 has an enlarged tip 61 with a tapered section 62. The drill hole has a larger diameter upper section 63 that is transitioned to a smaller diameter lower section 64 by a tapered section 65. This type of drill hole can be formed by a special drill bit assembly. The stemming bar 60 is inserted into the drill hole and the tapered section 62 seats on the tapered section 65 of the drill hole to form an initially tight seal for the high-pressure gases that will be generated in the hole bottom. The high pressure gases will cause the stemming bar 60 to recoil, thus opening up a gap between the tapered section 62 of the stemming bar 60 and the tapered section 65 of the drill hole. The tapered section 65 of the drill hole is less sensitive to chipping and imperfections in the rock than a sharply stepped drill hole such as shown in FIGS. 4,5 and 6 and thus the development of the gap and the leakage of high-pressure gases can be better controlled. This stemming bar configuration can be used with any of the cartridge configurations shown in FIGS. 4,5 and 6.

Figure 19:
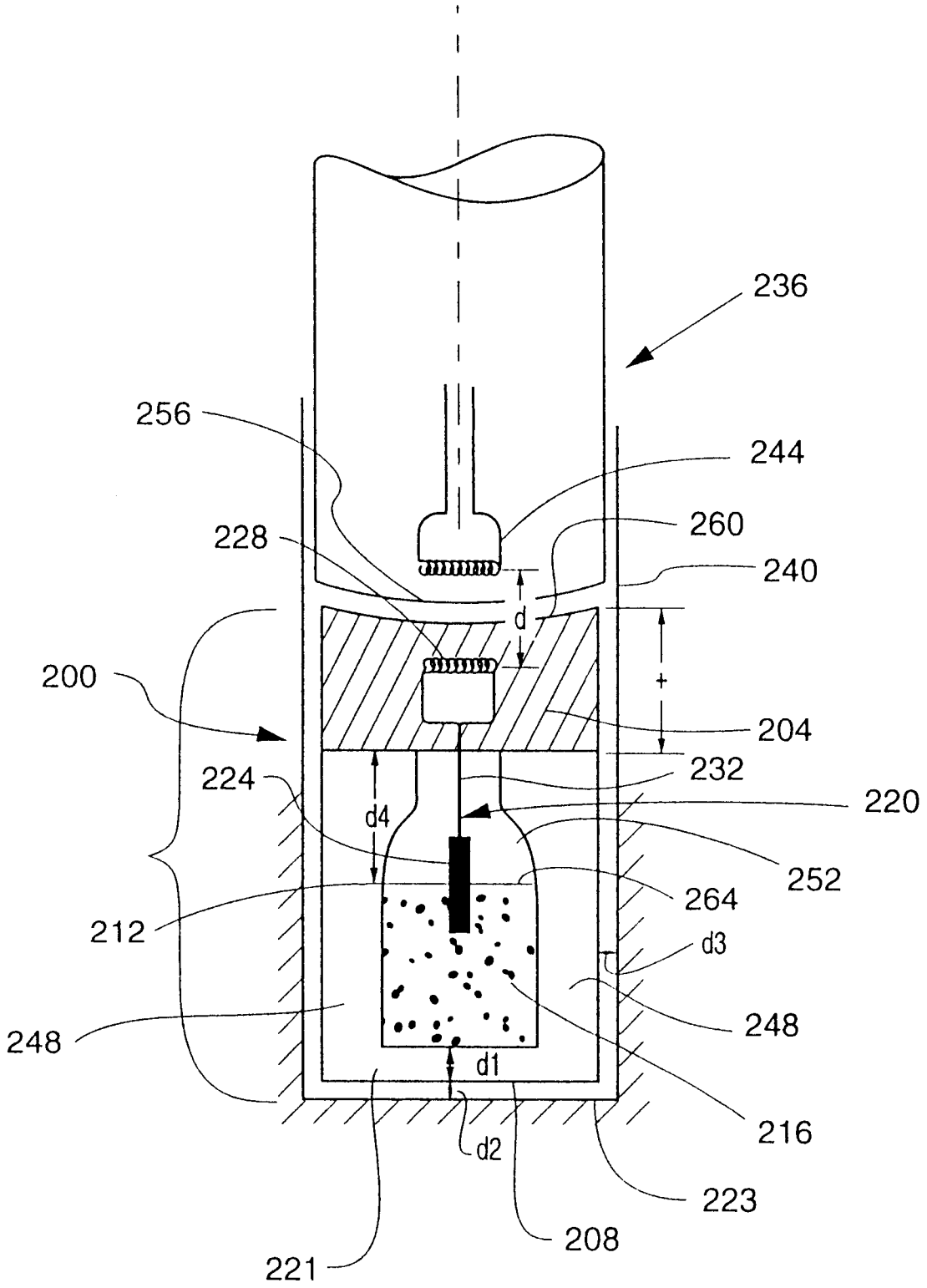
FIGS. 19 and 20 depicts another embodiment of a device according to the present invention.

FIG. 19 depicts another embodiment of an SCB-EX cartridge 200 according to the present invention. The cartridge 200 includes a sacrificial cartridge base 204, an outer cartridge housing 208, an inner cartridge housing 212, an explosive 216 and a detonation assembly 220. The detonation assembly 220 includes a detonation initiator 224, a secondary induction coil 228, and a conductor 232 for connecting the secondary induction coil 228 and the detonation initiator 224. A stemming bar 236 includes means for sealing the cartridge 200 in the hole 240 (i.e., the narrow gap between the stemming bar and the sides of the hole) and primary induction coil 244 in electrical contact with the secondary induction coil 228 for initiating detonation of the explosive.

The cartridge 200 includes a free volume 248 formed by the outer cartridge housing 208, cartridge base 204, and inner cartridge housing 212. The inner cartridge housing 212 further includes free volume 252 located between the explosive 216 and the cartridge base 204. Free volume 252 allows the pressure of the detonating explosive to attenuate by expansion to the point where it does not overload the cartridge base 204 and transmit excessive shock energy to the stemming bar 236. Free volumes 248 and 252 constitute most of the total free volume in the bottom of the hole 240. Preferably, free volume 252 ranges from about 20 to about 100% of the volume of the explosive 216. It is preferred that the total of free volume 252 and free volume 248 range from about 2 to about 5 times that of the volume of the explosive 216. Free volume 252 preferably represents from about 17 to about 50% of the total volume of the inner cartridge housing 212. The sum of the free volume 252, free volume 248, and the explosive 216 equals the total volume available to the gas generated by consuming the explosive 216. As will be appreciated, the free volume associated with the spacing between the outer cartridge housing 208 and the surface of the hole 240 provides a further small additional volume to the overall free volume in the hole bottom.

The cartridge base 204 protects the reuseable, down hole end 256 of the stemming bar from permanent damage during detonation of the explosive, contains part of the initiator system, and assists in sealing the bottom of the hole by occupying most of the cross-sectional area of the hole. The cartridge base preferably has a yield strength less than the yield strength of the stemming bar such that the cartridge base experiences plastic deformation in response to detonation of the explosive before the stemming bar. Preferably, the yield strength of the cartridge base is no more than about 75% of the yield strength of the stemming bar. The cartridge base can be composed of a variety of inexpensive materials, including steel, aluminum, plastic, composites, and the like. The thickness "t" of the cartridge base preferably ranges from about 0.5 to about 2 inches. The diameter of the cartridge base has a diameter ranging from about 50 to about 250 millimeters and has a length-to-diameter ratio ranging from about 0.15 to about 0.60.

The shape of the cartridge base 204 serves numerous purposes. By way of example, the outer end 260 of the cartridge base has the same shape as the end 256 of the stemming bar 236 so that the stemming bar 236 can be aligned with the cartridge 200 to permit the primary induction coil 244 to be electrically coupled with the secondary induction coil 228. As shown, the preferred shape of the outer end 260 of the cartridge base and the end 256 of the stemming means is curved. The cartridge base is conically shaped where the cartridge base connects to the outer cartridge housing 208. Accordingly, the portion of the outer cartridge housing 208 adjacent to the conically shaped portion of the cartridge base is tapered at the same angle as the taper of the conically shaped portion of the cartridge base. During detonation of the explosive, the conically shaped portion of the cartridge base forces the outer cartridge housing against the sides of the hole 240, thereby sealing the cartridge 200 in the hole bottom.

The outer cartridge housing 208 is cylindrically shaped and seals the inside of the cartridge 200 from any water or other liquids in the hole 240. As noted above, the outer cartridge housing contains the free volume necessary to control the average peak pressure developed in the hole bottom and thereby prevent overpressurization of the bottom 223 of the drill hole. For best results, the outer cartridge housing should fragment when the explosive detonates to inhibit large pieces of the housing from blocking or impeding gas flow into the fractures opened in the hole bottom. The outer cartridge housing can be composed of a number of materials, including steel, aluminum or plastic.

The dimensions of the cartridge depend upon the specific application. The wall thickness of the outer cartridge housing preferably ranges from about 0.75 to about 5 millimeters in underground excavation applications and from about 0.75 to about 5 mm in surface excavation applications. Preferably the nose portion 221 of the outer cartridge housing located at the opposite end of the outer cartridge housing from the cartridge base has a thickness ranging from about 0.01 to about 0.03 inches in underground excavation applications and from about 0.01 to about 0.03 in surface excavation applications.

The cartridge 200 has a maximum diameter ranging from about 50 to about 250 millimeters in underground excavation applications and from about 50 to about 250 mm in surface excavation applications. The cartridge has a preferred length-to-diameter ratio ranging from about 1 to about 4.

The inner cartridge housing 212 contains the explosive and positions the explosive in the hole 240. In other words, the inner cartridge housing positions the explosive (i) away from the side walls of the drill hole 240, (ii) away from the cartridge base 204, and (iii) maintains the desired spacing between the explosive and the hole bottom. As in the case of the outer cartridge housing, it is important that the inner cartridge housing fragment when the explosive detonates so that there are no large pieces to block or impede gas flow into the fractures open in the hole bottom. The inner cartridge housing can be a variety of materials, including steel, aluminum or plastic, and has a preferred wall thickness ranging from about 0.2 to about 1 millimeter.

The explosive can be any number of the explosive materials noted above. In the case of liquid explosives, a separating wall or membrane is required at the top 264 of the explosive to keep the explosive to the bottom portion of the inner cartridge housing. The mass of the explosive 216 preferably ranges from about 0.15 to about 0.5 kilograms in underground excavation applications and from about 1 to about 5 kilograms in surface excavation applications.

The detonation assembly 220 has a number of subcomponents as noted above. The initiator 224 is preferably a number 6 or number 8 blasting cap or other detonation initiation device. The secondary induction coil preferably has a sufficient wire diameter to carry electrical current pulse ranging from about 1 to about 5 amps. The primary induction coil 244 preferably has a sufficient wire diameter to carry an electrical current pulse ranging from about 20 to about 200 amps. For best results, the maximum distance ("d") between the primary and secondary induction coils is preferably no more than about 3 millimeters. A firing box energizes the primary induction coil 244 with a current pulse which induces a current in the secondary induction coil 228.

The spacial positions of the various components in the cartridge 200 are important for optimal performance of the cartridge. The distance "d1" between the bottom of the inner cartridge housing 212 and the bottom of the outer cartridge housing 208 determines the amount of fracturing in the rock induced by the cartridge. The maximum degree of fracturing is realized when the distance "d1" is substantially 0 and the outer cartridge housing contacts the bottom of the hole 240. Preferably, "d1" is no more than about 15 mm. The distance "d2" from the bottom of the outer cartridge housing to the bottom of the hole 240 is preferably maintained as low as possible without causing the outer cartridge housing to be pressed into the hole bottom by the force of insertion of the cartridge into the hole. As will be appreciated, the outer cartridge housing can sustain significant damage during insertion, including rupturing. Preferably, the distance "d2" is no more than about 15 millimeters. The distance "d3" is the clearance distance between the outer cartridge housing and the side walls of the drill hole 240. The distance "d3" is preferably enough to allow the cartridge to be easily inserted into the hole bottom without sustaining significant damage as noted above. The distance will, of course, vary with drill bit wear and overbreak in different rock types. Preferably, the distance "d3", ranges from about 0.2 to about 3 millimeters.

The stemming bar 236 has a weight sufficient to withstand a substantial portion of the recoil of the cartridge base 204 resulting from the detonation of the explosive 216. Preferably, the stemming bar has a weight ranging from about 25 to about 1,000 kilograms. The diameter of the stemming bar is sufficiently large to form a seal between the sides of the stemming bar 236 and the sides of the hole 240 to inhibit the escape of gas from the detonation of the explosive 216 from the hole bottom. Preferably, the diameter of the stemming bar 236 ranges from about 50 to about 250 millimeters in underground excavation applications and from about 50 to about 250 in surface excavation applications. Typically, the stemming bar has a cross-sectional area that is at least about 95% of the cross-sectional area of the hole.

To protect the end 256 of the stemming bar 236 from damage caused by the recoil of the cartridge base 204 from detonation of the explosive 216, the explosive 216 is positioned at a distance "d4" from the cartridge base to dissipate the detonation shock wave. For best results, the distance "d4" preferably ranges from about 0.5 to about 3 inches.

Figure 20:
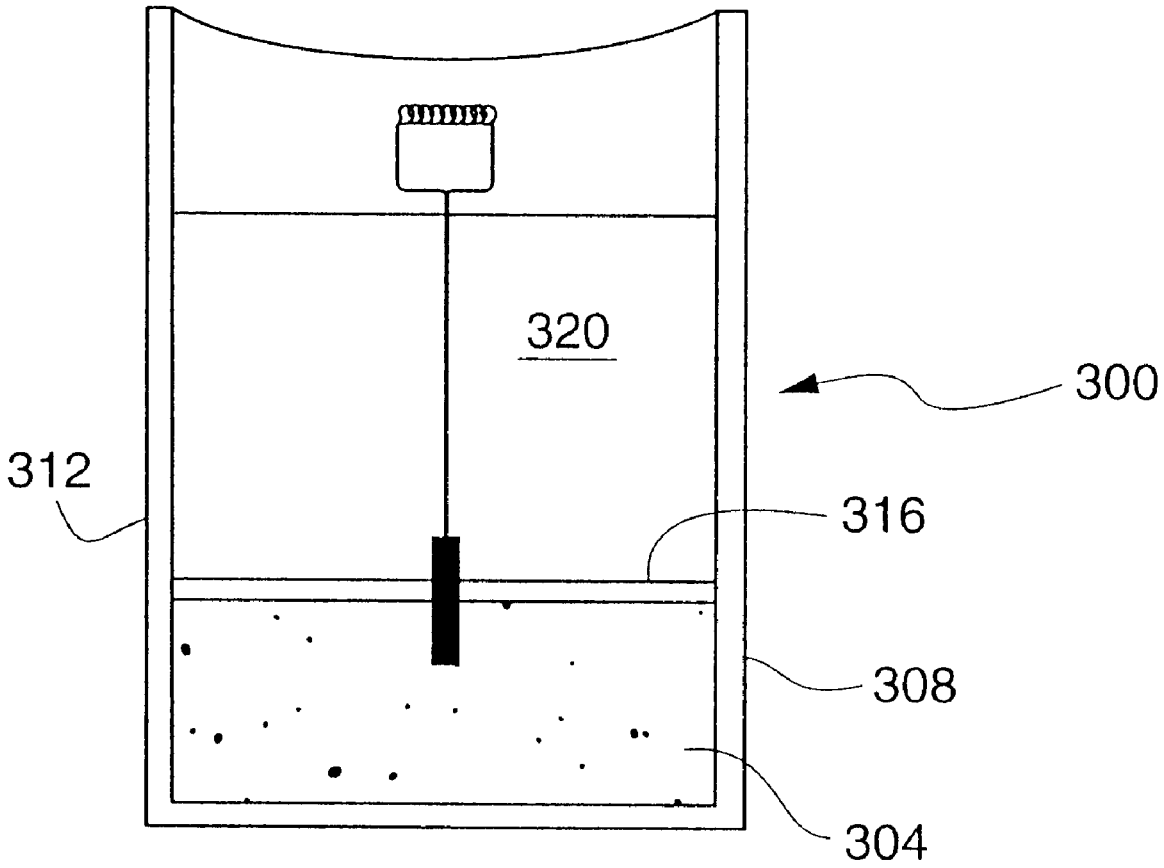

FIG. 20 depicts another embodiment of an SCB-EX cartridge 300 according to the present invention. Unlike the cartridge 200 of the previous embodiment, the cartridge 300 does not have an inner cartridge housing. Rather, the explosive 304 is located in the nose portion 308 of the outer cartridge housing 312. As noted above, a separating wall 316 is used to separate the explosive, especially liquid explosives, from the free volume 320 of the cartridge. Preferably, the free volume 320 represents from about 50 to about 75% of the total volume of the outer cartridge housing. The explosive occupies the remaining total volume of the outer cartridge housing.

FIG. 8 shows the SCB-EX system after firing in the situation where the cartridge wall 66 does not rupture near the end of the stemming bar 67. The explosive has been initiated and the pressures developed causes the stemming bar 67 and cartridge base plug 68 to recoil whilst expanding the cartridge walls 66 against the wall of the drill hole 69. The front portion of the cartridge has been fragmented causing the hole to fill with explosive product gases initiating a controlled fracture 70 at or near the bottom of the drill hole 71. The pressure forces the taper of the base plug 68 against the taper of the cartridge wall 72 during recoil to maintain a dynamic seal while the rock breaking process occurs.

FIG. 9 shows the SCB-EX system after firing in the situation where the cartridge wall 73 ruptures 74 near the end of the stemming bar 75. The cartridge wall 73 near the base plug 76 is assumed to have ruptured 74 and the high pressure explosive product gases then force the metal back-up ring 77 into the gap 78 between the end of the stemming bar 75 and the wall of the drill hole 79, sealing the system against leakage of gas from the hole bottom.

The performance of the SCB-EX method for the case of a de-coupled explosive charge is shown in FIG. 10 by the calculated pressure history on the bottom of the drill hole. The calculation is for the case when the rock does not fracture. The pressure 80 is shown as a function of time 81. A pressure spike 82 is immediately generated as a result of the expansion of the explosive products across the gap (see FIG. 5). The pressure oscillates 83 as the gas generated by the explosive products sloshes back and forth in the volume available. The pressure decays 84 with time as the stemming bar recoils (increasing the volume available) and as gas leaks past the stemming bar. The pressure is shown on the hole bottom for about 4 milliseconds.

The performance of the SCR-EX method for the case of a de-coupled explosive charge is shown in FIG. 11 by the calculated pressure history on the bottom of the drill hole. The calculation is for the case when the rock fractures. The pressure 85 is shown as a function of time 86. A pressure spike 87 is immediately generated as a result of the expansion of the explosive products across the gap (see FIG. 5). The pressure oscillates 88 as the gas generated by the explosive products sloshes back and forth in the volume available. The pressure decays 89 with time as the stemming bar recoils (increasing the volume available); as gas leaks past the stemming bar and as gas flows into the developing fracture system. The pressure is shown on the hole bottom for about 4 milliseconds.

The calculated gas distribution within the SCB-EX cartridge and hole bottom is shown in FIG. 12. The calculation is for the case when the rock fractures and corresponds to the pressure history shown in FIG. 11. The mass of gas remaining in the cartridge volume 90, the mass of gas leaked from the system 91 and the mass of gas injected into the hole bottom and fracture system 92 are shown as a function of time 93. After initiation, the explosive product gases expand to fill the entire cartridge and hole bottom volume. When the pressure reaches a critical threshold (on the order of 30 of the unconfined compressive strength of the rock), a fracture is initiated. Gas continues to flow from the cartridge into the expanding fracture system. Concurrently, in this calculation, the cartridge wall near the cartridge base plug is assumed to rupture after recoil of 2.5 millimeters has occurred, thus allowing gas to leak through the gap between the stemming bar and the wall of the drill hole. The mass flow rate of gas is assumed to leak at the sonic choke condition which is dictated by the cross-sectional area of the gap and the local gas sound speed and density. After 4 milliseconds, the fracture will have reached the surface of the rock face and the rock fragmentation is considered complete. As can be seen, a small fraction of the gas has leaked from the system (18 grams of the original 200 grams). Most of the gas (137 grams of the original 200 grams) has been injected into the hole bottom and fracture system.

The performance of the SCB-EX method for the case of a closely coupled explosive charge is shown in FIG. 13 by the calculated pressure history on the bottom of the drill hole. The calculation is for the case when the rock fractures. The pressure 94 is shown as a function of time 95. A strong pressure spike 96 is immediately generated as a result of the reflection of the detonation wave from the explosive in contact with the bottom of the cartridge (see FIG. 4). The pressure oscillates 97 as the gas generated by the explosive products sloshes back and forth in the volume available. The pressure decays 98 with time as the stemming bar recoils (increasing the volume available); as gas leaks past the stemming bar and as gas flows into the developing fracture system. The pressure is shown on the hole bottom for about 4 milliseconds.

The performance of the a non-explosive Charge-in-the-Hole method using a propellant is shown in FIG. 14 by the calculated pressure history on the bottom of the drill hole. The calculation is for the case when the rock does not fracture and can be compared to the SCB-EX example of FIG. 10. The pressure 99 is shown as a function of time 100. There is a distinct lack of a pressure spike and the pressure rises relatively slowly compared to the SCB-EX method. The pressure decays 101 with time as the stemming bar recoils (increasing the volume available); and as gas leaks past the stemming bar. The pressure is shown on the hole bottom for about 4 milliseconds.

The performance of the a Gas-Injector device using a propellant is shown in FIG. 15 by the calculated pressure history on the bottom of the drill hole. The calculation is for the case when the rock does not fracture and can be compared to the SCB-EX example of FIG. 10 and the Charge-in-the-Hole example of FIG. 14. The pressure 102 is shown as a function of time 103. There is a distinct lack of a pressure spike and the pressure rises relatively slowly compared to the SCB-EX method. The pressure decays 104 with time as the stemming bar recoils (increasing the volume available); as gas leaks past the stemming bar; and as the gas blows back up the barrel of the gas-injector. The pressure is shown on the hole bottom for about 4 milliseconds.

The calculated gas distribution within the Gas-Injector system and hole bottom is shown in FIG. 16. The calculation is for the case when the rock fractures. The mass of gas in the gas-injector volume 105, the mass of gas leaked from the system 106 and the mass of gas injected into the hole bottom and fracture system 107 is shown as a function of time 108. Approximately 4 milliseconds after the pressure has been on the bottom of the hole, a fracture will have reached the surface of the rock face and the rock fragmentation can be considered complete. As can be seen, a significant fraction of the gas has leaked from the system (61 grams of the original 380 grams). Much of the gas (145 grams of the original 380 grams) remains within the gas-injector. The gas remaining in the gas-injector after rock fragmentation is complete may be the source of much of the air-blast and energetic flyrock often associated with this method.

A possible rock excavation system based on the use of a SCB-EX system is shown in FIG. 17. There are two articulating boom assemblies 108 and 109 attached to a mobile undercarrier 110. The boom assembly 108 has an SCB-EX small-charge blasting apparatus 111 mounted on it. The boom assembly 109 has an optional mechanical impact breaker 112 and backhoe attachment 113 for moving broken rock from the workface to a conveyor system 114 which passes the broken rock through the excavator to a haulage system (not shown).

Figure 18:
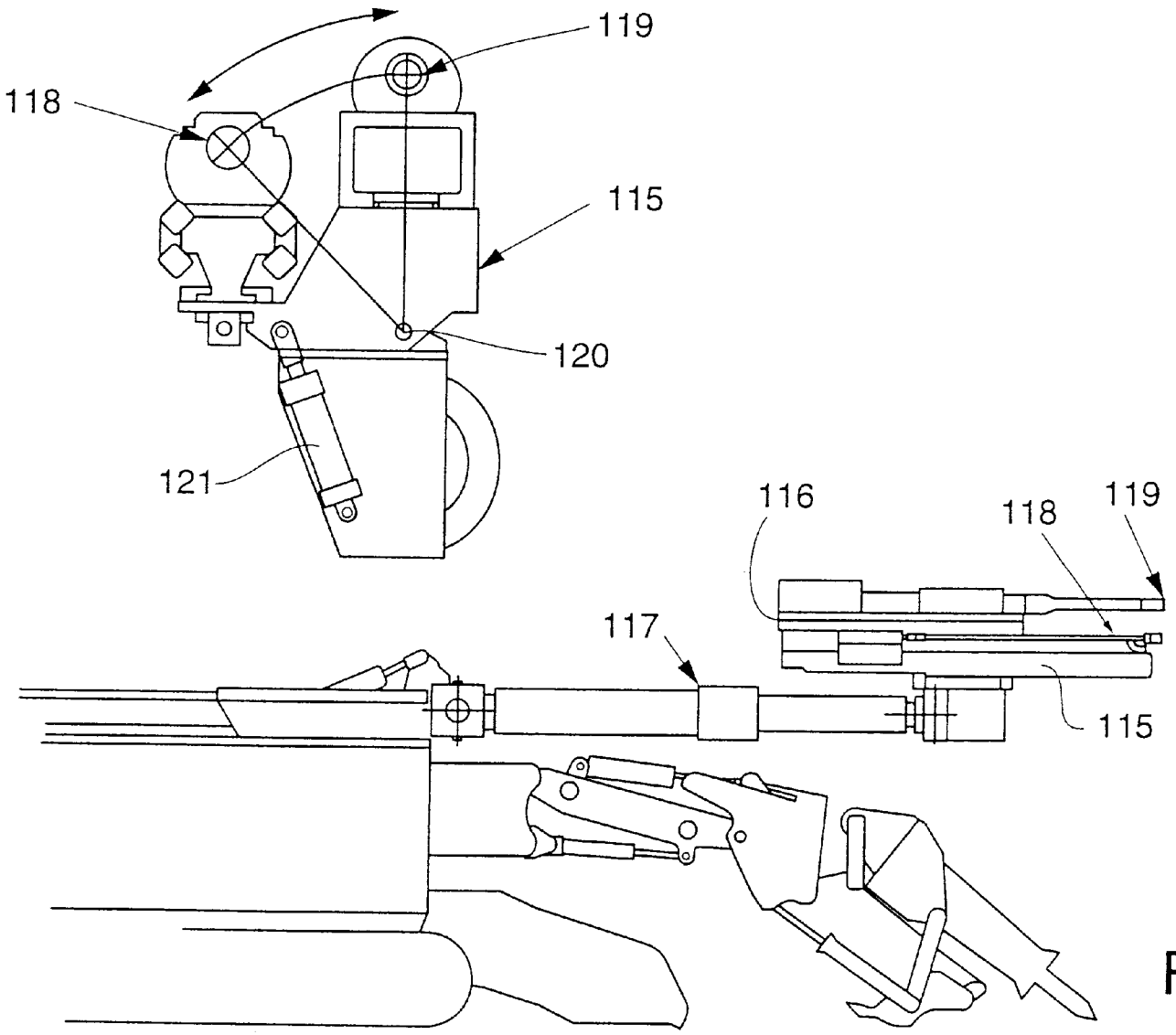
FIG. 18 is (1) a cutaway side view of a small-charge blasting apparatus mounted on an indexing mechanism which is in turn mounted on the end of an articulating boom assembly and (2) a head-on view of the indexing mechanism showing a rock drill and a small-charge blasting apparatus.

A typical indexing mechanism for the small-charge blasting apparatus is shown in FIG. 18. The indexing mechanism 115 connects the SCB-EX small-charge blasting apparatus 116 to the articulating boom 117. A rock drill 118 and an SCB-EX insertion mechanism 119 are mounted on the indexer 115. The boom 117 positions the indexer assembly at the rock face so that the rock drill 118 can drill a short hole (not shown) into the rock face (also not shown). When the rock drill 118 is withdrawn from the hole, the indexer 115 is rotated about its axis 120 by a hydraulic mechanism 121 so as to align the SCB-EX insertion mechanism 119 with the axis of the drill hole. The SCB-EX insertion mechanism 119 is then inserted into the drill hole and the small-charge is ready for ignition.

While the invention has been described with reference to specific embodiments, modifications and variations of the invention of the invention may be constructed without departing from the scope of the invention, which is described in the following claims.

What is claimed is:

1. A device for fracturing a hard material, comprising:

a cartridge; and a stemming means for holding the cartridge in a hole in the material, the cartridge being located adjacent to an end of the stemming means and including:

a cartridge base positioned adjacent to the end of the stemming means; and an outer cartridge housing attached to the cartridge base, a first portion of the outer cartridge housing containing an explosive and a second portion a space for controlling the gas pressure in the hole, wherein at least a portion of a surface of the explosive, that is adjacent to a surface of the cartridge base, is positioned at a distance from and separated by a gap from at least a portion of the surface of the cartridge base to dissipate a detonation shock wave generated during detonation of the explosive and thereby retard damage to the stemming means by the detonation shock wave.

2. The device of claim 1, wherein the cartridge base has a thickness ranging from about 50 to about 250 mm.

3. The device of claim 1, wherein the stemming means has a first yield strength and the cartridge base a second yield strength and the second yield strength is no more than about 75% of said first yield strength.

4. The device of claim 1, wherein the stemming means has a first yield strength and the cartridge base a second yield strength and the second yield strength is less than the first yield strength such that the cartridge base plastically deforms in response to the detonation shock wave before the stemming means.

5. The device of claim 1, wherein the cartridge base is conically shaped and the portion of the outer cartridge housing adjacent to the cartridge base is tapered to seal the cartridge in the hole when the cartridge base recoils from the detonation shock wave.

6. The device of claim 1, wherein the nose portion of the outer cartridge housing located at the opposite end of the outer cartridge housing from the cartridge base has a thickness ranging from about 0.75 to about 5 mm.

7. The device of claim 1, wherein the explosive is selected from the group consisting of a mixture of ammonium nitrate and nitromethane, dynamite, Composition 3, Composition 4, Octol, emulsion explosives, water gel explosives, and geliguite.

8. The device of claim 1, wherein the space has a space volume and the explosive an explosive volume and the space volume ranging from about 200 to about 500% of the explosive volume.

9. The device of claim 1, wherein the explosive is spaced from the bottom of the hole by a distance of no more than about 15 mm.

10. The device of claim 1, wherein the distance ranges from about 0.5 to about 3.0 inches.

11. The device of claim 1 wherein at least one of the stemming means and cartridge base includes guidance means for aligning the cartridge base relative to the end of the stemming means.

12. The device of claim 11, wherein the stemming means includes a primary inductance coil and the cartridge base a secondary inductance coil, with the primary and secondary inductance coils being electrically coupled to one another for initiating detonation of the explosive.

13. The device of claim 1, wherein the cartridge has a length-to-diameter ratio ranging from about 1 to about 4.

14. The device of claim 1, further comprising:

sealing means for sealing the cartridge in the bottom of the hole to pressurize the hole bottom and form a fracture from a bottom corner of the hole.

15. The device of claim 1, wherein the cartridge base has a length-to-diameter ratio ranging from about 0.15 to about 0.60.

16. The device of claim 1, wherein the space has a space volume and the space volume ranges from about 50 to about 75% of the total volume of the outer cartridge housing.

17. A device for fracturing a hard material, comprising:

a cartridge; and a stemming means for holding the cartridge in a hole in the material, the cartridge being located adjacent to an end of the stemming means and including:

a cartridge base positioned adjacent to the end of the stemming means; and an outer cartridge housing attached to the cartridge base, a first portion of the outer cartridge housing containing an explosive and a second portion a space for controlling the gas pressure in the hole, wherein at least a portion of the explosive is positioned at a distance, from the cartridge base to dissipate a detonation shock wave generated during detonation of the explosive, wherein the space has a space volume and the explosive an explosive volume and the space volume ranges from about 200 to about 500% of the explosive volume.

18. The device of claim 17, wherein the stemming means has a first yield strength and the cartridge base a second yield strength and the second yield strength is no more than about 75% of said first yield strength.

19. A device for fracturing a hard material, comprising:

a cartridge; and a stemming means for holding the cartridge in a hole in the material, the cartridge being located adjacent to an end of the stemming means and including:

a cartridge base positioned adjacent to the end of the stemming means; and an outer cartridge housing attached to the cartridge base, a first portion of the outer cartridge housing containing an explosive and a second portion a space for controlling the gas pressure in the hole, wherein at least a portion of the explosive is positioned at a distance from the cartridge base to dissipate a detonation shock wave generated during detonation of the explosive, wherein the stemming means includes a primary inductance coil and the cartridge base a secondary inductance coil, with the primary and secondary inductance coils being electrically coupled to one another for initiating detonation of the explosive.

20. The device of claim 19, wherein the space has a space volume and the explosive an explosive volume and the space volume ranges from about 200 to about 500% of the explosive volume.

* * * * *